US007876314B2

(12) United States Patent
Uchino et al.

(10) Patent No.: US 7,876,314 B2
(45) Date of Patent: Jan. 25, 2011

(54) DISPLAY APPARATUS AND DRIVING METHOD THEREFOR

(75) Inventors: Katsuhide Uchino, Kanagawa (JP); Junichi Yamashita, Tokyo (JP); Naobumi Toyomura, Kanagawa (JP)

(73) Assignee: Sony Corporation, Tokyo (JP)

( * ) Notice: Subject to any disclaimer, the term of this patent is extended or adjusted under 35 U.S.C. 154(b) by 897 days.

(21) Appl. No.: 11/808,522

(22) Filed: Jun. 11, 2007

(65) Prior Publication Data

US 2008/0001545 A1 Jan. 3, 2008

(30) Foreign Application Priority Data

Jun. 30, 2006 (JP) ..... 2006-180522

(51) Int. Cl.
*G09G 5/00* (2006.01)

(52) U.S. Cl. ..... 345/208; 345/78; 345/204

(58) Field of Classification Search ..... None
See application file for complete search history.

(56) References Cited

U.S. PATENT DOCUMENTS

| | | | | |
|---|---|---|---|---|
| 7,057,588 | B2 | 6/2006 | Asano et al. | |
| 7,102,202 | B2 | 9/2006 | Kobayashi et al. | |
| 7,109,952 | B2 | 9/2006 | Kwon et al. | |
| 2005/0007357 | A1* | 1/2005 | Yamashita et al. | 345/204 |
| 2005/0206509 | A1 | 9/2005 | Becker et al. | |
| 2005/0212732 | A1* | 9/2005 | Aoki | 345/76 |
| 2005/0269959 | A1* | 12/2005 | Uchino et al. | 315/169.3 |
| 2006/0061560 | A1* | 3/2006 | Yamashita et al. | 345/204 |

FOREIGN PATENT DOCUMENTS

| | | |
|---|---|---|
| EP | 1 785 979 A2 | 5/2007 |
| JP | 2003-255856 | 9/2003 |
| JP | 2003-271095 | 9/2003 |
| JP | 2004-029791 | 1/2004 |
| JP | 2004-093682 | 3/2004 |
| JP | 2004-133240 | 4/2004 |
| JP | 2005-172917 | 6/2005 |
| JP | 2005-345722 | 12/2005 |

(Continued)

OTHER PUBLICATIONS

Extended European Search Report issued Mar. 23, 2010 for corresponding European Application No. 07 25 2576.

*Primary Examiner*—Bipin Shalwala
*Assistant Examiner*—Daniel Bedell
(74) *Attorney, Agent, or Firm*—Rader, Fishman & Grauer PLLC

(57) ABSTRACT

A display apparatus includes a pixel array section and a driving section configured to drive the pixel array section. The pixel array section includes a plurality of first scanning lines and a plurality of second scanning lines extending along rows, a plurality of signal lines extending along columns, a plurality of pixels arranged in a matrix at positions at which the first and second scanning lines and the signal lines intersect with each other, and a plurality of power supply lines and a plurality of ground lines configured to perform feeding to the pixels. The driving section includes a first scanner, a second scanner, and a signal selector. Each of the pixels includes a light emitting element, a sampling transistor, a drive transistor, a switching transistor, and a pixel capacitance.

8 Claims, 16 Drawing Sheets

FOREIGN PATENT DOCUMENTS

| | | | |
|---|---|---|---|
| JP | 2005-345722 | A | 12/2005 |
| JP | 2005-345723 | | 12/2005 |
| JP | 2006-038965 | | 2/2006 |
| JP | 2007-310311 | | 11/2007 |
| JP | 2008-009198 | A | 1/2008 |

* cited by examiner $$Ids = k\mu(Vgs - Vth)^2 = k\mu(Vsig - \Delta V)^2$$

$$OUT=\overline{\overline{DS2}\cdot WS\cdot DSEN1+DS1\cdot DSEN2}$$

WS — WS PULSE TO S/R (WS·S/R·in)

DS1 — DS PULSE TO S/R (DS·S/R·in)

DS2 — DS PULSE FROM S/R (DS·S/R·OUT)

FIG.19A
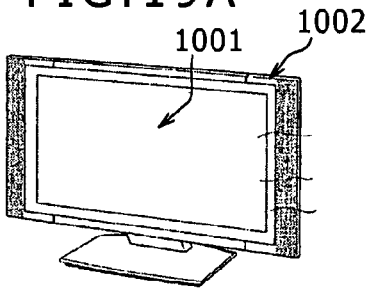
FIG.19B
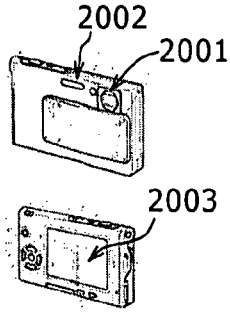
FIG.19C
FIG.19D
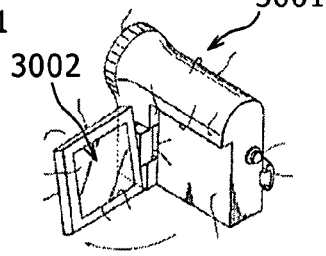
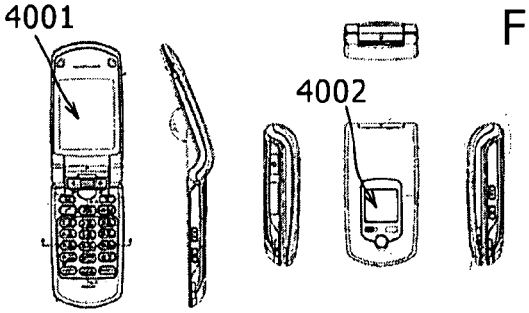
FIG.19E
FIG.19F
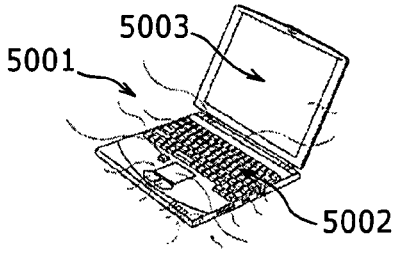
FIG.19G
FIG.20
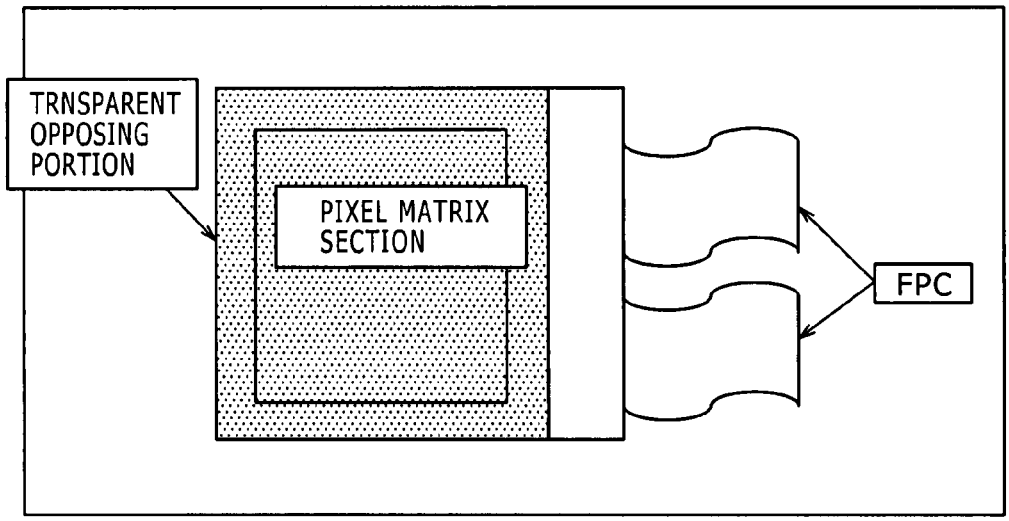

DISPLAY APPARATUS AND DRIVING METHOD THEREFOR

CROSS REFERENCES TO RELATED APPLICATIONS

The present invention contains subject matter related to Japanese Patent Application JP 2006-180522 filed with the Japan Patent Office on Jun. 30, 2006, the entire contents of which being incorporated herein by reference.

BACKGROUND OF THE INVENTION

1. Field of the Invention

This invention relates a display apparatus and a driving method therefore wherein light emitting elements arranged in individual pixels are driven by current to display an image, and more particularly to an active matrix type display apparatus and a driving method therefore wherein the current amount to be supplied to a light emitting element such as an organic EL (electroluminescence) element is controlled by means of an insulated gate type electric field effect transistor provided in each pixel circuit.

2. Description of the Related Art

In an image display apparatus such as, for example, a liquid crystal display unit, in order to display an image, a great number of liquid crystal pixels are arranged in a matrix and the transmission intensity or the reflection intensity of incoming light is controlled for each pixel in response to image information to be displayed. While the configuration just described is similar also to that of an organic EL display unit or the like wherein an organic EL element is used for pixels, the organic EL element is, different from the liquid crystal pixel, a self-luminous element. Therefore, the organic EL display unit is advantageous in that the visibility of an image is high in comparison with the liquid crystal display unit and a backlight does not have to be provided and besides the speed of response is high. Further, the organic EL display unit is of the current controlled type wherein the luminance level (gradation) of each light emitting element can be controlled in accordance with the value of current flowing therethrough. In this regard, the organic EL display unit is much different from a display unit of the voltage controlled type such as a liquid crystal display unit.

In an organic EL display unit, a simple matrix system and an active matrix system are available as a driving system similarly as in a liquid crystal display unit. The simple matrix system has a problem in that, while it is simple in structure, it is difficult to implement a display unit of a large size and a high definition. Therefore, at present, development of display units of the active matrix type is carried out popularly. According to the active matrix system, the current to be supplied to the light emitting element in each pixel circuit is controlled by an active element provided in the pixel circuit. Usually, a thin film transistor (TFT) is used as the active element. The active matrix system is disclosed, for example, in Japanese Patent Laid-Open Nos. 2003-255856, 2003-271095, 2004-133240, 2004-029791 and 2004-093682.

SUMMARY OF THE INVENTION

An existing pixel circuit is arranged at each of positions at which scanning lines extending along rows for supplying a control signal and signal lines extending along columns for supplying an image signal intersect with each other. The pixel circuit includes a sampling transistor, a pixel capacitance, a drive transistor and a light emitting element. The sampling transistor is rendered conducting in response to the control signal supplied from the associated scanning line to sample the image signal supplied from the associated signal line. The pixel capacitance retains an input voltage according to a signal potential of the sampled image signal. The drive transistor supplies output current as driving current within a predetermined light emitting period in response to the input voltage retained in the pixel capacitance. It is to be noted that generally the output current has the dependability upon the carrier mobility and the threshold voltage of a channel region of the drive transistor. The light emitting element emits light with luminance according to the image signal in accordance with the output current supplied from the drive transistor.

The drive transistor receives the input voltage retained in the pixel capacitance at the gate thereof and supplies output current between the source and the drain thereof to energize the light emitting element. Generally, the luminance of emitted light of the light emitting element increases in proportion to the amount of current supplied. Further, the output current supplying amount of the drive transistor is controlled by the gate voltage, that is, the input voltage written in the pixel capacitance. The existing pixel circuit varies the input voltage to be applied to the gate of the drive transistor in response to the input image signal to control the current amount to be supplied to the light emitting element.

The drive transistor has an operation characteristic represented by the following expression (1):

$$Ids=(1/2)\mu(W/L)\mathrm{Cox}(Vgs-Vth)2 \quad (1)$$

where Ids is the drain current flowing between the source and the drain of the drive transistor and is, in the pixel circuit, output current supplied to the light emitting element; Vgs is the gate voltage applied to the gate with reference to the source and is, in the pixel circuit, the input voltage described hereinabove; Vth is the threshold voltage of the drive transistor; $\mu$ is the mobility of a semiconductor thin film which forms a channel of the drive transistor; W is the channel width; L is the channel length; and Cox is the gate capacitance. As can be seen apparently from the characteristic expression (1) above, when the thin film transistor operates in its saturation region, if the gate voltage Vgs increases beyond the threshold voltage Vth, then the transistor is placed into an on state and drain current Ids flows. Theoretically, if the gate voltage Vgs is fixed, then a normally equal amount of drain current Ids is supplied to the light emitting element as indicated by the transistor characteristic expression (1) given above. Accordingly, it is considered that, if an image signal of an equal level is supplied to pixels which form the screen, then all pixels emit light with equal luminance and uniformity of the screen is achieved.

Actually, however, the device characteristics of individual thin film transistors (TFTs) formed from a semiconductor thin film of polycrystalline silicon or a like material exhibit some dispersion. Particularly the threshold voltage Vth is not uniform but disperses among the pixels. As can be recognized apparently from the transistor characteristic expression (1) given hereinabove, if the threshold voltage Vth disperses among drive transistors, then even if the gate voltage Vgs is fixed, a dispersion appears in the drain current Ids, resulting in difference in luminance among the pixels. As a result, uniformity of the screen is damaged. A pixel circuit which incorporates a function of canceling the dispersion of the threshold voltage among drive transistors has been developed in the related art and disclosed, for example, in Japanese Patent Laid-Open No. 2004-133240 mentioned hereinabove.

However, the main factor of the dispersion of output current of light emitting elements is not limited to the threshold voltage Vth of the drive transistor. As can be recognized apparently from the transistor characteristic expression (1) given hereinabove, the output current Ids fluctuates also when the mobility μ of the drive transistor disperses. As a result, the uniformity of the screen is damaged. Also to cancel the dispersion in mobility is one of subjects to be solved. Therefore, it is demanded to provide a display apparatus and a driving method therefor wherein the mobility of a drive transistor can be corrected for each pixel.

Also it is demanded to provide a display apparatus and a driving method therefor wherein mobility correction can be carried out adaptively in response to the luminance level of a pixel.

According to an embodiment of the present invention, there is provided a display apparatus including a pixel array section, and a driving section configured to drive the pixel array section. The pixel array section includes a plurality of first scanning lines and a plurality of second scanning lines extending along rows, a plurality of signal lines extending along columns, a plurality of pixels arranged in a matrix at positions at which the first and second scanning lines and the signal lines intersect with each other, and a plurality of power supply lines and a plurality of ground lines configured to perform feeding to the pixels. The driving section includes a first scanner configured to successively supply a first control signal to the first scanning lines to perform line sequential scanning of the pixels in a unit of a row, a second scanner configured to successively supply a second control signal to the second scanning lines in accordance with the line sequential scanning, and a signal selector configured to supply an image signal to the signal lines in accordance with the line sequential scanning. Each of the pixels includes a light emitting element, a sampling transistor, a drive transistor, a switching transistor and a pixel capacitance. The sampling transistor is connected at the gate, source and drain thereof to a corresponding one of the first scanning lines, a corresponding one of the signal lines and the gate of the drive transistor, respectively. The drive transistor and the light emitting element are connected in series between a corresponding one of the power supply lines and a corresponding one of the ground lines to form a current path. The switching transistor is inserted in the current path, the switching transistor being connected at the gate thereof to a corresponding one of the second scanning lines, the pixel capacitance being connected between the source and gate of the drive transistor. The sampling transistor is switched on in response to the first control signal supplied thereto from the first scanning line to sample a signal potential of the image signal supplied from the signal line and retain the signal potential into the pixel capacitance. The switching transistor is switched on in response to the second control signal supplied from the second scanning line to place the current path into a conducting state. The drive transistor supplies driving current to the light emitting element through the current path placed in the conducting state in response to the signal potential retained in the pixel capacitance. The driving section applies correction for the mobility of the drive transistor to the signal potential retained in the pixel capacitance within a correction period from a first timing at which, after the first control signal is applied to the first scanning line to turn on the sampling transistor to start sampling of the signal potential, the second control signal is applied to the second scanning line to turn on the switching transistor to a second timing at which the first control signal applied to the first scanning line is cancelled to turn off the sampling transistor thereby to automatically adjust the second timing such that the correction period decreases as the signal potential of the image signal supplied to the signal line increases but the correction period increases as the signal potential of the image signal supplied to the signal line decreases.

Preferably, each of the pixels further includes an additional switching transistor configured to reset the gate potential and source potential of the drive transistor prior to the sampling of the image signal, and the second scanner temporarily turns on the switching transistor through the second control line prior to the sampling of the image signal thereby to supply driving current to the drive transistor in the reset state to retain a voltage corresponding to the threshold voltage of the drive transistor into the pixel capacitance. Preferably, the first scanner applies a gradient to a falling edge waveform of the first control signal when the sampling transistor is switched off at the second timing to automatically adjust the second timing such that the correction period decreases as the signal potential increases but the correction period increases as the signal potential of the image signal supplied to the signal line decreases. In this instance, the display apparatus is preferably configured such that, when the gradient is applied to the falling edge waveform of the first control signal, the first scanner first applies a steep gradient to the falling edge waveform of the first control signal and then applies a moderate gradient to the falling edge waveform of the first control signal so that the correction period is optimized in both cases wherein the signal potential is high and wherein the signal potential is low. Or, the display apparatus may be configured such that the driving section includes a power supply pulse production circuit configured to produce a first power supply pulse on which the falling edge waveform of the first control signal is based and supply the first power supply pulse to the first scanner, and the first scanner successively extracts the falling edge waveform from the first power supply pulse and supplies the extracted falling edge waveform as the falling edge waveform of the first control signal to the first scanning line. In this instance, the display apparatus may be configured such that the power supply pulse production circuit produces a second power supply pulse on which the waveform of the second control signal is based and supplies the produced second power supply pulse to the second scanner, and the second scanner successively extracts part of the waveform from the second power supply pulse and supplies the extracted waveform as the waveform of the second control signal at the first timing to the second scanning line. Or, the display apparatus may be configured such that the first scanner produces the waveform of the first control signal at the second timing which is an end point of the correction period based on the first power supply pulse supplied from the power supply pulse production circuit, and the second scanner produces the waveform of the second control signal at the first timing which is a start point of the correction period by an internal logical process.

In the display apparatus, part of a sampling period within which the signal potential is sampled into the pixel capacitance is utilized to perform correction for the mobility of the drive transistor. In particular, within the latter half of the sampling period, the switching transistor is turned on to place the current path into a conducting state so that driving current is supplied to the driver transistor. The driving current has a magnitude corresponding to the sampled signal potential. At this stage, the light emitting element is in a reversely biased state, and the driving current does not flow through the light emitting element but is charged into the parasitic capacitance of the light emitting diode and the pixel capacitance. Thereafter, the sampling pulse falls, and the gate of the drive transistor is disconnected from the signal line. Within the correction period after the switching transistor is turned on until the sampling transistor is turned off, the driving current is negatively fed back to the pixel capacitance from the drive transistor, and the thus fed back driving current amount is subtracted from the signal potential sampled in the pixel capacitance. Since the negatively fed back amount acts in a direction in which the dispersion of the mobility of the drive transistor is suppressed, mobility correction is performed for each pixel. In particular, where the mobility of the drive transistor is high, the negatively fed back amount to the pixel capacitance is great and the amount by which the signal potential retained in the pixel capacitance is subtracted is great, and as a result, the output current of the drive transistor is suppressed. On the other hand, if the mobility of the drive transistor is low, also the negatively fed back amount is small, and the signal potential retained in the pixel capacitance is not influenced very much by the negatively fed back amount. Accordingly, the output current of the drive transistor does not decrease very much. Here, the negatively fed back amount has a level according to the signal potential to be applied directly from the signal line to the gate of the drive transistor. In other words, as the signal potential increases to increase the luminance, the negatively fed back amount increases. In this manner, the mobility correction is performed in response to the luminance level.

However, the optimum correction period is not necessarily same between a case wherein the luminance is high and another case wherein the luminance is low. Generally, the optimum correction period has a tendency that it is comparatively short where the luminance has a high level (white level), but it is comparatively long where the luminance has an intermediate level (gray level). According to an embodiment of the present invention, the correction period is automatically optimized in response to the luminance level. In particular, the second timing at which the sampling transistor is turned off is automatically adjusted in response to the signal potential with respect to the first timing at which the switching transistor is turned on. More particularly, the second timing is adaptively controlled such that, as the signal potential of the image signal to be supplied from the signal light increases, the correction period decreases, but as the signal potential of the image signal to be supplied from the signal line decreases, the correction period increases. By the adaptive control, the correction period can be variably controlled optimally in response to the signal potential. As a result, the uniformity of the screen can be improved significantly.

The above and other features and advantages of the present invention will become apparent from the following description and the appended claims, taken in conjunction with the accompanying drawings in which like parts or elements denoted by like reference symbols.

BRIEF DESCRIPTION OF THE DRAWINGS

FIG. 19A is a perspective view showing a television set to which the present invention is applied;

FIGS. 19B and 19C are front and rear elevational views showing a digital camera to which the present invention is applied;

FIG. 19D is a perspective view showing a video camera to which the present invention is applied;

FIGS. 19E and 19F are schematic views showing a cellular phone unit to which the present invention is applied;

FIG. 19G is a perspective view showing a notebook personal computer to which the present invention is applied; and FIG. 20 is a schematic view showing a display apparatus in the form of a module.

DETAILED DESCRIPTION OF THE PREFERRED EMBODIMENTS

Figure 1:
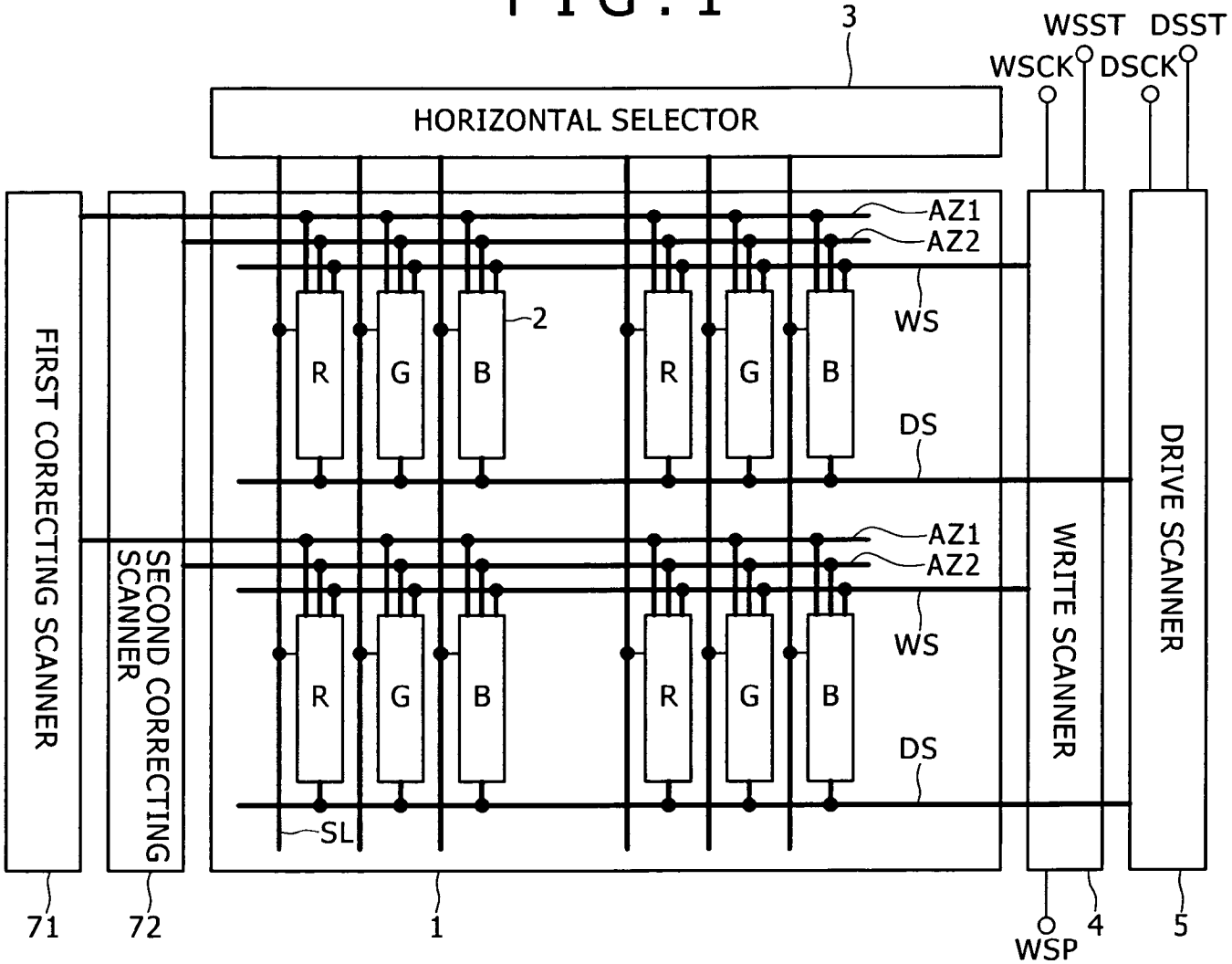
FIG. 1 is a schematic block diagram showing principal components of a display apparatus to which the present invention is applied.

Referring first to FIG. 1, there is shown a general configuration of a display apparatus to which the present invention is applied. The display apparatus shown includes, as basic components thereof, a pixel array section 1 and a driving section including a scanner section and a signal section. The pixel array section 1 includes scanning lines WS, scanning lines AZ1, scanning lines AZ2 and scanning lines DS extending along rows, signal lines SL extending along columns, and pixel circuits 2 disposed in a matrix and connected to the scanning lines WS, AZ1, AZ2 and DS and the signal lines SL. The pixel array section 1 further includes a plurality of power supply lines for supplying a first potential Vss1, a second potential Vss2 and a third potential Vcc necessary for operation of the pixel circuits 2. The signal section includes a horizontal selector 3 and supplies an image signal to the signal lines SL. The scanner section includes a write scanner 4, a drive scanner 5, a first correcting scanner 71 and a second correcting scanner 72 for supplying control signals to the scanning lines WS, DS, AZ1 and AZ2, respectively, to successively scan the pixel circuits 2 for each row.

The write scanner 4 is formed from a shift register and operates in response to a clock signal WSCK supplied thereto from the outside to successively transfer a start signal WSST supplied thereto similarly from the outside to successively output the start signal WSST to the scanning lines WS. Thereupon, the write scanner 4 utilizes a power supply pulse WSP supplied thereto similarly from the outside to produce a falling edge waveform of a control signal WS. Also the drive scanner 5 is formed from a shift register and operates in response to a clock signal DSCK supplied thereto from the outside to successively transfer a start signal DSST supplied thereto similarly from the outside to successively output a control signal DS to the scanning lines DS.

Figure 2:
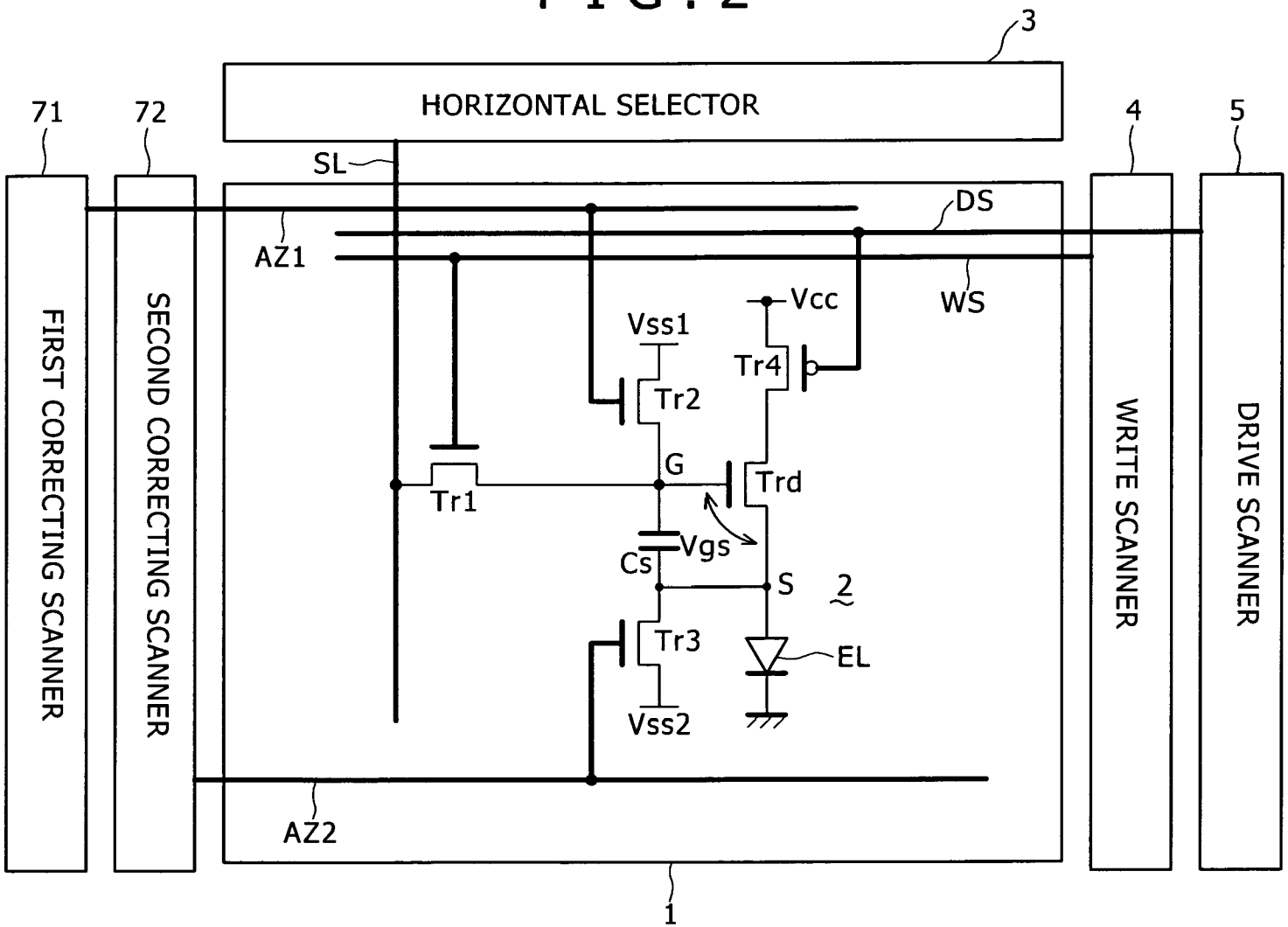
FIG. 2 is a circuit diagram showing a configuration of a pixel circuit of the display apparatus.

FIG. 2 shows an example of a configuration of a pixel circuit incorporated in the image display apparatus shown in FIG. 1. Referring to FIG. 2, the pixel circuit 2 shown includes a sampling transistor Tr1, a drive transistor Trd, a first switching transistor Tr2, a second switching transistor Tr3, a third switching transistor Tr4, a pixel capacitance Cs, and a light emitting element EL. The sampling transistor Tr1 is rendered conducting in response to a control signal supplied thereto from an associated scanning line WS within a predetermined sampling period to sample a signal potential of an image signal supplied thereto from an associated signal line SL into the pixel capacitance Cs. The pixel capacitance Cs applies an input voltage Vgs to the gate G of the drive transistor Trd in response to the sampled signal potential of the image signal. The drive transistor Trd supplies output current Ids in response to the input voltage Vgs to the light emitting element EL. The light emitting element EL emits light with luminance according to the signal potential of the image signal based on the output current Ids supplied thereto from the drive transistor Trd within a predetermined light emitting period.

The first switching transistor Tr2 is rendered conducting in response to a control signal supplied thereto from an associated scanning line AZ1 prior to the sampling period to set the gate G of the drive transistor Trd to the first potential Vss1. The second switching transistor Tr3 is rendered conducting in response to a control signal supplied thereto from an associated scanning line AZ2 prior to the sampling period to set the source S of the drive transistor Trd to the second potential Vss2. The third switching transistor Tr4 is rendered conducting in response to a control signal supplied thereto from an associated scanning line DS prior to the sampling period to connect the drive transistor Trd to the third potential Vcc so that a voltage corresponding to a threshold voltage Vth of the drive transistor Trd is retained into the pixel capacitance Cs to cancel the influence of the threshold voltage Vth. Further, the third switching transistor Tr4 is rendered conducting in response to a control signal supplied thereto from the control signal DS again within the light emitting period to connect the drive transistor Trd to the third potential Vcc thereby to supply output current Ids to the light emitting element EL.

As apparent from the foregoing description, the present pixel circuit 2 is formed from five transistors Tr1 to Tr4 and Trd, one pixel capacitance Cs and one light emitting element EL. The transistors Tr1 to Tr3 and Trd are N-channel polycrystalline silicon thin film transistors (TFTs). The third switching transistor Tr4 is a P-channel polycrystalline TFT. However, according to the present invention, the pixel circuit 2 is not limited to this but may otherwise be formed from a suitable combination of N-channel and P-channel polycrystalline silicon TFTS. The light emitting element EL is, for example, an organic EL (electroluminescence) device of the diode type having an anode and a cathode. However, according to the present invention, the light emitting element EL is not limited to this, but may be formed from any device which emits light when it is driven by current.

Figure 3:
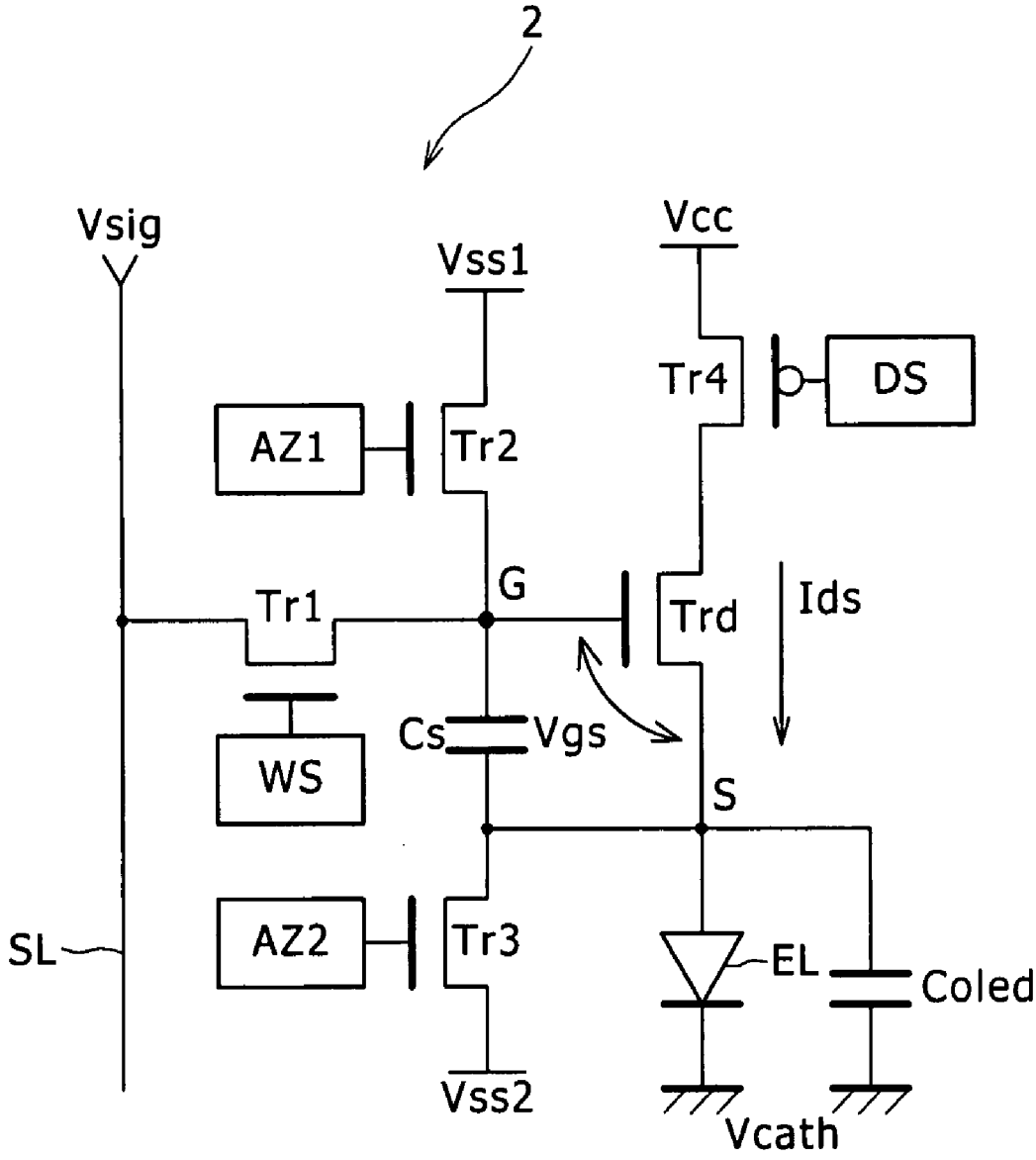
FIG. 3 is a circuit diagram illustrating operation of the pixel circuit.

FIG. 3 shows the pixel circuit 2 from within the image display circuit shown in FIG. 2. In order to facilitate the understandings, a signal potential Vsig of an image signal sampled by the sampling transistor Tr1, an input voltage Vgs and output current Ids of the drive transistor Trd, a capacitance component Coled of the light emitting element EL and so forth are additionally indicated in FIG. 3. In the following, operation of the pixel circuit 2 of the display apparatus to which the present invention is applied is described with reference to FIGS. 3 and 4.

Figure 4:
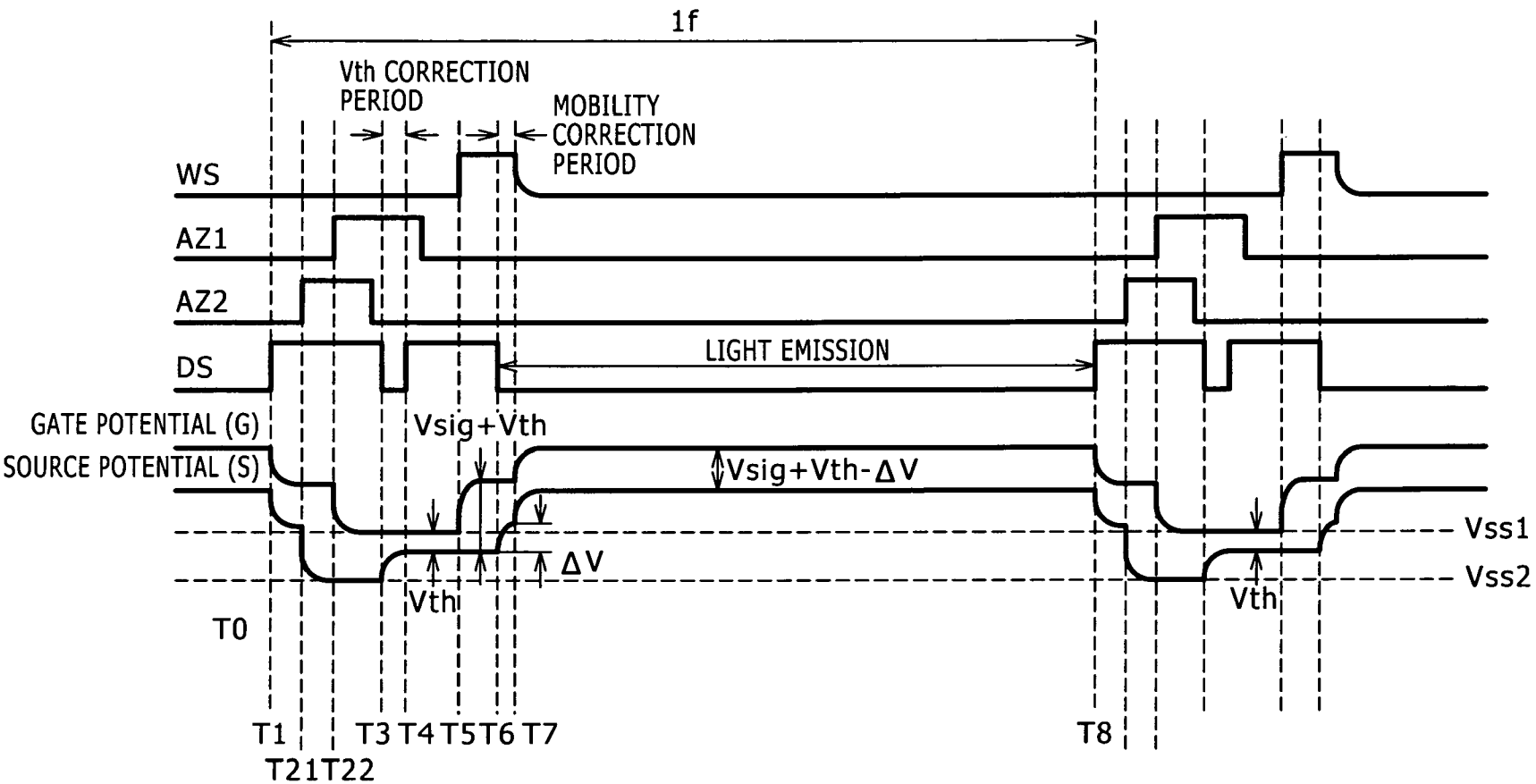
FIG. 4 is a timing chart illustrating operation of the display apparatus.

FIG. 4 illustrates operation of the pixel circuit shown in FIG. 3. In FIG. 4, the waveform of control signals applied to the scanning lines WS, AZ1, AZ2 and DS are illustrated along a time axis T. For simplified illustration, also the control signals are denoted by reference characters same as those of the corresponding scanning lines. Since the transistors Tr1, Tr2 and Tr3 are of the N-channel type, they exhibit an on state when the scanning lines WS, AZ1 and AZ2 have the high level, but exhibit an off state when the scanning lines WS, AZ1 and AZ2 have the low level, respectively. Meanwhile, since the third switching transistor Tr4 is of the P-channel type, it exhibits an off state when the control signal DS has the high level, but exhibits an on state when the control signal DS has the low level. It is to be noted that the timing chart of FIG. 4 illustrates also a potential variation of the gate G and a potential variation of the source S of the drive transistor Trd together with the waveforms of the scanning lines WS, AZ1, AZ2 and DS.

In the timing chart of FIG. 4, timings T1 to T8 correspond to one field (1f). The rows of the pixel array are successively scanned once within a period of one field. The timing chart illustrates waveforms of the control signals WS, AZ1, AZ2 and DS applied to pixels in one row.

At timing T0 before the field is started, all of the control signals WS, AZ1, AZ2 and DS have the low level. Accordingly, the N-channel transistors Tr1, Tr2 and Tr3 are in an off state while only the P-channel third switching transistor Tr4 is in an on state. Accordingly, the drive transistor Trd is connected to the power supply Vcc through the third switching transistor Tr4 which is in an on state and supplies output current Ids to the light emitting element EL in response to the predetermined input voltage Vgs. Accordingly, the light emitting element EL is in a light emitting state at timing T0. At this time, the input voltage Vgs applied to the drive transistor Trd is represented by the difference between the gate potential (G) and the source potential (S).

At timing T1 at which the field starts, the control signal DS changes over from the low level to the high level. Consequently, the third switching transistor Tr4 is turned off and the drive transistor Trd is disconnected from the power supply Vcc. Consequently, the light emitting element EL stops the emission of light and enters a no-light emitting period. Accordingly, after timing T1, all of the transistors Tr1 to Tr4 are in an off state.

At timing T21 after timing T1, the control signal AZ2 rises and the second switching transistor Tr3 is turned on. Consequently, the source (S) of the drive transistor Trd is initialized to the predetermined second potential Vss2. Then at timing T22, the control signal AZ1 rises and the first switching transistor Tr2 is turned on. Consequently, the gate potential (G) of the drive transistor Trd is initialized to the predetermined first potential Vss1. As a result, the gate G of the drive transistor Trd is connected to the reference potential Vss1 and the source S of the drive transistor Trd is connected to the reference potential Vss2. Here, the relationship of Vss1−Vss2>Vth is satisfied, and the input voltage Vgs is set so as to satisfy Vss1−Vss2=Vgs>Vth thereby to make preparations for Vth correction to be performed later at timing T3. In other words, the period T21−T3 corresponds to a reset period of the drive transistor Trd. Further, where the threshold voltage of the light emitting element EL is represented by VthEL, it is set so as to satisfy VthEL>Vss2. Consequently, a negative bias is applied to the light emitting element EL, and therefore, the light emitting element EL is placed into a reversely biased state. The reversely biased state is necessary in order to perform Vth correction operation and mobility correction operation, which are to be performed later, normally.

At timing T3, the control signal DS is set to the low level after the control signal AZ2 is set to the low level. Consequently, the transistor Tr3 is turned off while the transistor Tr4 is turned on. As a result, drain current Ids flows into the pixel capacitance Cs to start Vth correction operation. At this time, the gate G of the drive transistor Trd is held at the first potential Vss1, and consequently, the current Ids flows until the drive transistor Trd is cut off. After the drive transistor Trd is cut off, the source potential (S) of the drive transistor Trd becomes Vss1−Vth. At timing T4 after the drain current is cut off, the control signal DS is changed back to the high level to turn off the switching transistor Tr4. Also the control signal AZ1 is changed back to the low level to turn off the switching transistor Tr2 as well. As a result, the threshold voltage Vth is retained and fixed in the pixel capacitance Cs. In this manner, within the period between the timings T3 and T4, the threshold voltage Vth of the drive transistor Trd is detected. The detection period T3-T4 is called Vth correction period.

At timing T5 after the Vth correction is performed in this manner, the control signal WS is changed over to the high level to turn on the sampling transistor Tr1 so that the signal potential Vsig of the image signal is written into the pixel capacitance Cs. The pixel capacitance Cs is sufficiently low when compared with the equivalent capacitance Coled of the light emitting element EL. As a result, most part of the signal potential Vsig of the image signal is written into the pixel capacitance Cs. More accurately, the difference Vsig−Vss1 of the first potential Vss1 from the signal potential Vsig is written into the pixel capacitance Cs. Accordingly, the voltage Vgs between the gate G and the source S of the drive transistor Trd becomes a level (Vsig−Vss1+Vth) equal to the sum of the threshold voltage Vth detected and retained as described above and the difference Vsig−Vss1 sampled in the present cycle. If it is assumed for simplified description that the first potential Vss1 is Vss1=0 V, then the voltage Vgs becomes equal to Vsig+Vth as seen in the timing chart of FIG. 4. Such sampling of the signal potential Vsig of the image signal is performed till timing T7 at which the control signal WS returns to the low level. In other words, the period between the timings T5 to T7 corresponds to a sampling period.

At timing T6 prior to timing T7 at which the sampling period comes to an end, the control signal DS changes to the low level and the third switching transistor Tr4 is turned on. Consequently, the drive transistor Trd is connected to the power supply Vcc. As a result, the pixel circuit advances from the no-light emitting period to a light emitting period. Within the period T6-T7 within which the sampling transistor Tr1 remains in an on state and the third switching transistor Tr4 is placed in an on state in this manner, mobility correction of the drive transistor Trd is performed. In other words, according to an embodiment of the present invention, mobility correction is performed within the period T6-T7 within which a rear portion of a sampling period and a first portion of a light emitting period overlap with each other. It is to be noted that, at the top of the light emitting period within which the mobility correction is performed, the light emitting element EL by no means emits light actually because it is in a reversely biased state. Within this mobility correction period T6-T7, drain current Ids flows through the drive transistor Trd in a state wherein the gate G of the drive transistor Trd is fixed to the level of the signal potential Vsig of the image signal. Here, since the light emitting element EL is placed in a reversely biased state by setting the first potential Vss1 so as to satisfy Vss1−Vth<VthE1, it exhibits not a diode characteristic but a simple capacitance characteristic. Therefore, the current Ids flowing through the drive transistor Trd is written into a capacitance C=Cs+Coled where both of the pixel capacitance Cs and the equivalent capacitance Coled of the light emitting element EL are coupled. Consequently, the source potential (S) of the drive transistor Trd gradually rises. In the timing chart of FIG. 4, the rise is represented by ΔV. Since this rise ΔV is subtracted from the gate/source voltage Vgs retained in the pixel capacitance Cs after all, this is equivalent to application of negative feedback. The mobility μ can be corrected by negatively feeding back the output current Ids of the drive transistor Trd to the input voltage Vgs of the same drive transistor Trd in this manner. It is to be noted that the negative feedback amount ΔV can be optimized by adjusting the time axis T of the mobility correction period T6-T7. To this end, a gradient is provided to the falling edge of the control signal WS.

At timing T7, the control signal WS changes over to the low level and the sampling transistor Tr1 is turned off. As a result, the gate G of the drive transistor Trd is disconnected from the signal line SL. Since the application of the signal potential Vsig of the image signal is canceled, the gate potential (G) of the drive transistor Trd is permitted to rise and thus rises together with the source potential (S). Meanwhile, the gate/source voltage Vgs retained in the pixel capacitance Cs keeps the value of (Vsig−ΔV+Vth). As the source potential (S) rises, the reverse bias state of the light emitting element EL is eliminated, and consequently, the light emitting element EL begins to actually emit light as the output current Ids flows into the light emitting element EL. The relationship between the drain current Ids and the gate voltage Vgs at this time is given by the following expression (2) by substituting Vsig−ΔV+Vth into Vgs of the transistor characteristic expression 1 given hereinabove:

$$Ids=k\mu(Vgs-Vth)2=k\mu(Vsig-\Delta V)2 \quad (2)$$

where k=(½)(W/L)Cox. From the characteristic expression (2), it can be recognized that the term of Vth is canceled and the output current Ids supplied to the light emitting element EL does not rely upon the threshold voltage Vth of the drive transistor Trd. The drain current Ids basically depends upon the signal potential Vsig of the image signal. In other words, the light emitting element EL emits light with luminance according to the signal potential Vsig of the image signal. Thereupon, the signal potential Vsig is corrected with the feedback amount ΔV. This correction amount ΔV acts so at to cancel the effect of the mobility μ positioned just at the coefficient part of the characteristic expression 2. Accordingly, the drain current Ids substantially relies upon the signal potential Vsig of the image signal.

Finally at timing T8, the control signal DS changes over to the high level and the third switching transistor Tr4 is turned off. Consequently, the emission of light comes to an end and the field comes to an end. Thereafter, the pixel circuit performs operation for a next field and repeats the Vth correction operation, signal potential sampling operation, mobility correction operation and light emitting operation described above.

Figure 5:
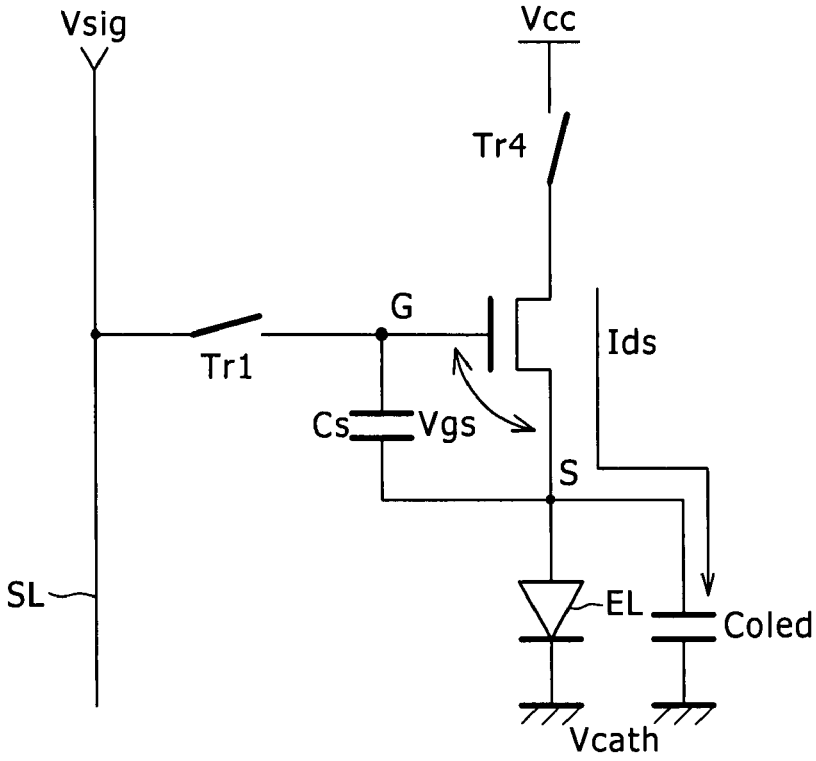
FIG. 5 is a schematic circuit diagram illustrating operation of the display apparatus.

FIG. 5 illustrates a state of the pixel circuit 2 within the mobility correction period T6-T7. Referring to FIG. 5, within the mobility correction period T6-T7, the sampling transistor. Tr1 and the switching transistor Tr4 exhibit an on state while the remaining switching transistors Tr2 and Tr3 exhibit an off state. In this state, the source potential (S) of the drive transistor Trd is Vss1−Vth. This source potential (S) is also the anode potential of the light emitting element EL. Where the first potential Vss1 is set so as to satisfy Vss1−Vth<VthEL as described hereinabove, the light emitting element EL is placed in a reversely biased state and indicates not a diode characteristic but a simple capacitance characteristic. Therefore, the current Ids flowing through the drive transistor Trd flows into the composite capacitance C=Cs+Coled of the pixel capacitance Cs and the equivalent component Coled of the light emitting element EL. In other words, part of the drain current Ids is negatively fed back to the pixel capacitance Cs thereby to perform correction of the mobility.

Figure 6:
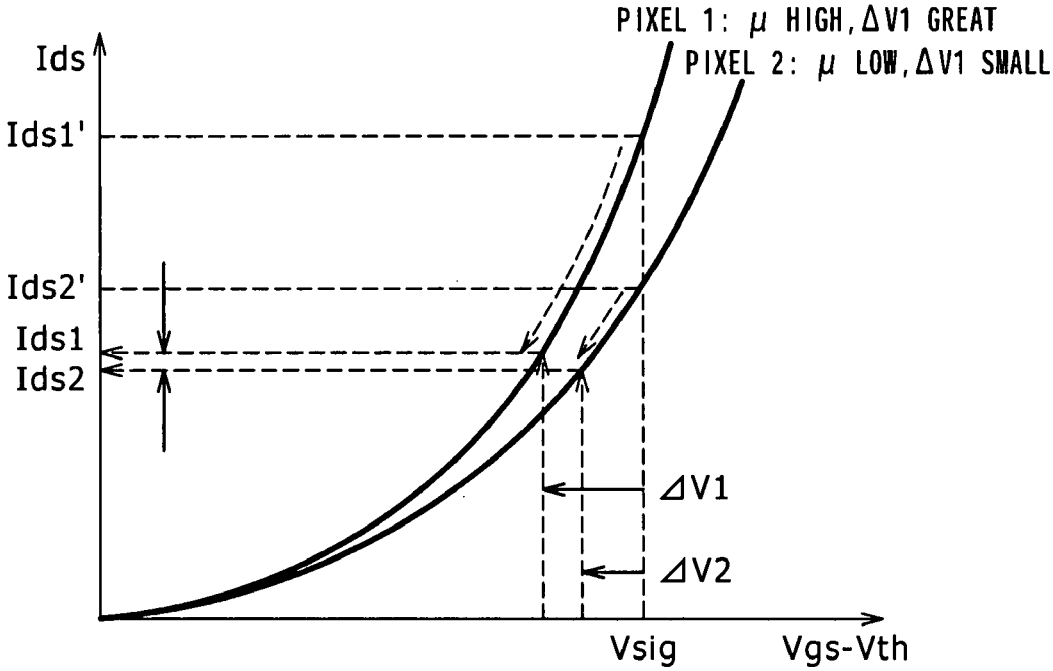
FIGS. 6 and 7 are graphs illustrating operation of the display apparatus.

FIG. 6 illustrates a graph representing the transistor characteristic expression (2) given hereinabove, and in FIG. 6, the axis of abscissa indicates the drain current Ids and the axis of ordinate indicates the signal potential Vsig. Also the characteristic expression (2) is indicated below the graph. The graph of FIG. 6 indicates characteristic curves regarding a pixel 1 and another pixel 2 for comparison. The mobility μ of the drive transistor of the pixel 1 is comparatively high. On the contrary, the mobility μ of the drive transistor of the pixel 2 is comparatively low. Where the drive transistors are formed each from a polycrystalline silicon thin film transistor, it may not be avoided that the mobility μ disperses between the pixels in this manner. For example, if the signal potentials Vsig of an image signal having an equal level are written into the pixels 1 and 2, then the output current Ids1' flowing to the pixel 1 having the high mobility μ exhibits a significant difference from the output current Ids2' flowing through to the pixel 2 having the low mobility μ. Since the dispersion in mobility μ gives rise to a significant difference in output current Ids in this manner, irregular stripe patterns are generated and deteriorate the uniformity of the screen.

Therefore, the output current is negatively fed back to the input voltage side to cancel the dispersion of the mobility. As apparent from the transistor characteristic expression (1) given hereinabove, as the mobility increases, the drain current Ids increases. Accordingly, as the negative feedback amount ΔV increases, the mobility increases. As seen from the graph of FIG. 6, the negative feedback amount ΔV1 of the pixel 1 having the higher mobility μ is greater than the negative feedback amount ΔV2 of the pixel 2 having the lower mobility μ. Accordingly, as the mobility μ increases, the negative feedback is applied by a greater amount, and consequently, the dispersion can be suppressed. If the pixel 1 having the higher mobility μ is corrected by the negative feedback amount ΔV1, then the output current decreases by a great amount from Ids1' to Ids1. On the other hand, since the correction amount ΔV2 for the pixel 2 having the low mobility μ is small, the output current Ids2' does not decrease very much to Ids2. As a result, the output current Ids1 and the output current Ids2 become substantially equal to each other and the dispersion in mobility is canceled. Since the cancellation of the dispersion in mobility is performed within the overall range of the signal potential Vsig from the black level to the white level, the uniformity of the screen becomes very high. In summary, where the pixels 1 and 2 are different in mobility from each other, the correction amount ΔV1 for the pixel 1 having the high mobility becomes smaller than the correction amount ΔV2 for the pixel 2 having the low mobility. In other words, as the mobility increases, the negative feedback amount ΔV increases and the decreasing amount of the output current Ids increases. Consequently, pixel current values of pixels different in mobility from each other are uniformed, and the dispersion in mobility can be canceled.

In the following, a numerical value analysis in mobility correction described hereinabove is described for the reference. An analysis is performed in a state wherein the source potential of the drive transistor Trd is taken as a variable V in a state wherein the transistors Tr1 and Tr4 are in an on state as seen in FIG. 5. Where the source potential (S) of the drive transistor Trd is represented by V, the drain current Ids flowing through the drive transistor Trd is given by the following expression (3):

$$I_{ds}k\mu(Vx_{gs}-V_{th})^2=k\mu(V_{sig}-V-V_{th})^2 \tag{3}$$

Further, from a relationship between the drain current Ids and the capacitance C (=Cs+Coled), Ids=dQ/dt=CdV/dt is satisfied as seen from the following expression (4):

$$\begin{aligned} I_{ds} &= \frac{dQ}{dt} = C\frac{dV}{dt} \pounds y \int \frac{1}{C}dt = \int \frac{1}{I_{ds}}dV \\ &\Leftrightarrow \int_0^t \frac{1}{C}dt = \int_{-Vth}^{V} \frac{1}{k\mu(V_{sig}-V_{th}-V)^2}dV \\ &\Leftrightarrow \frac{k\mu}{C}t = \left[\frac{1}{V_{sig}-V_{th}-V}\right]_{-Vth}^{V} = \frac{1}{V_{sig}-V_{th}-V} - \frac{1}{V_{sig}} \\ &\Leftrightarrow V_{sig}-V_{th}-V = \frac{1}{\frac{1}{V_{sig}}+\frac{k\mu}{C}t} = \frac{V_{sig}}{1+V_{sig}\frac{k\mu}{C}t} \end{aligned} \tag{4}$$

The expression (3) is substituted into the expression (4), and the opposite sides of a resulting expression are integrated. Here, it is assumed that the initial state of the variable V is −Vth and the mobility dispersion correction time (T6-T7) is represented by t. If this differential equation is solved, then pixel current for the mobility correction time t is given by the following expression (5):

$$I_{ds} = k\mu\left(\frac{V_{sig}}{1+V_{sig}\frac{k\mu}{C}t}\right)^2 \tag{5}$$

Figure 7:
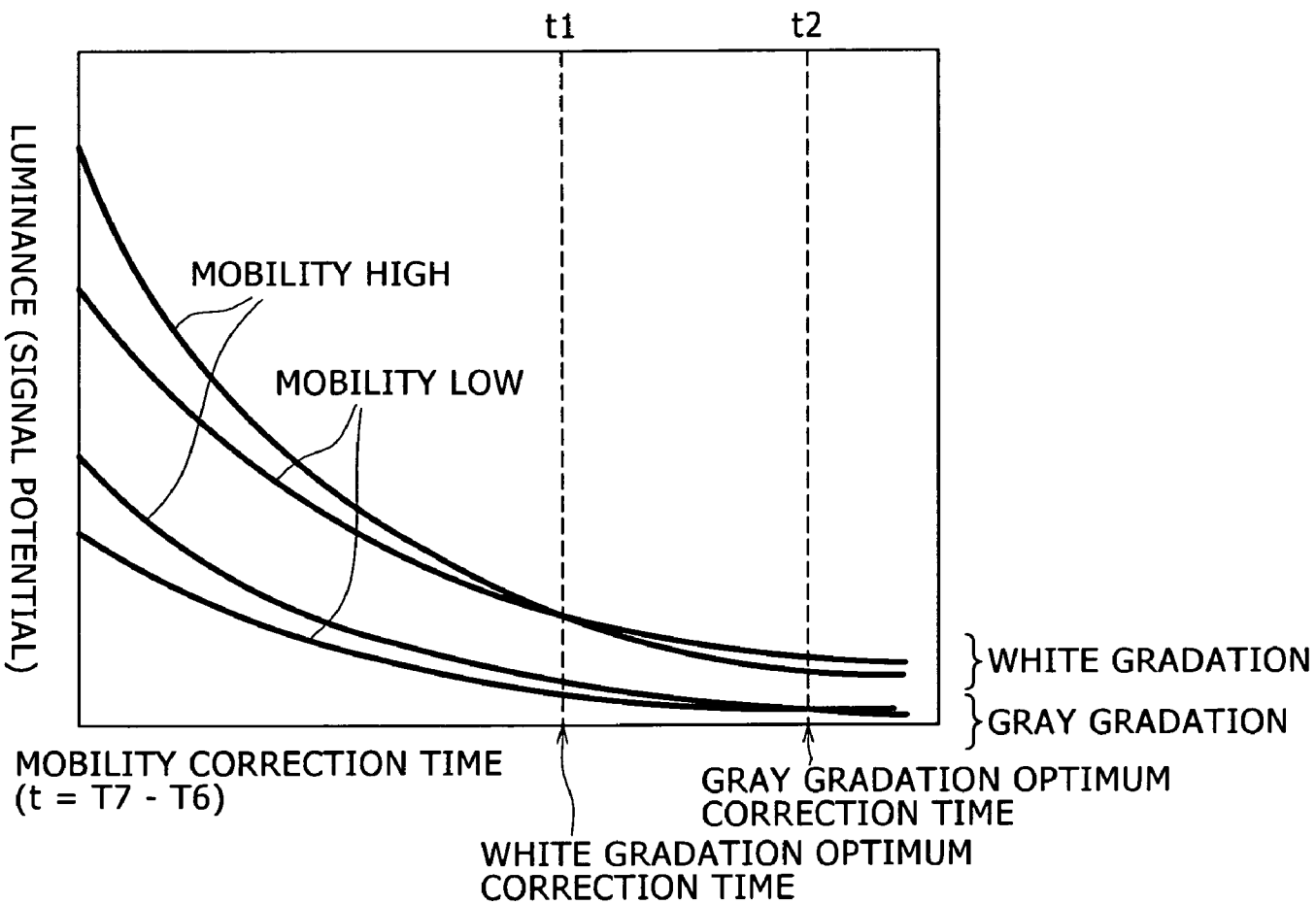

Incidentally, the optimum mobility correction time t has a tendency that it is different depending upon the luminance level of a pixel (that is, the signal potential Vsig of the image signal). This is described below with reference to FIG. 7. In the graph of FIG. 7, the axis of abscissa indicates the mobility correction time t (T7-T6), and the axis of ordinate indicates the luminance (signal potential). Where the luminance is high (white gradation), when the mobility correction time is set to t1 using a drive transistor having high mobility and another drive transistor having low mobility, the luminance levels are just equal to each other. That is, when the input signal potential corresponds to white gradation, the mobility correction time t1 is the optimum correction time. On the other hand, when the signal potential corresponds to intermediate gradation (gray gradation), the transistor having the high mobility and the transistor having the low mobility exhibit a difference in luminance and full correction may not be performed in the mobility correction time t1. If correction time t2 longer than the mobility correction time t1 is assured, then the luminance levels of the transistor of the high mobility and the transistor of the low mobility become just equal to each other. Accordingly, when the signal potential corresponds to gray gradation, the optimum correction time t2 is longer than the optimum correction time t1 in the case of white gradation.

On the other hand, if the mobility correction time t is fixed without depending upon the luminance level, then it is impossible to perform mobility correction fully at all gradations, and irregular stripe patterns appear. For example, if the mobility correction time t is adjusted to the optimum correction time t1 of the white gradation, then stripe patterns remain on the screen when the input image signal indicates gray gradation. On the contrary, if the mobility correction time t is fixed to the optimum correction time t2 of a gray gradation, then irregular stripe patterns appear on the screen when the image signal indicates the white gradation. In other words, if the mobility correction time t is fixed, then it is impossible to cancel the mobility dispersions simultaneously over all gradations from the white to the gray gradation.

Figure 8:
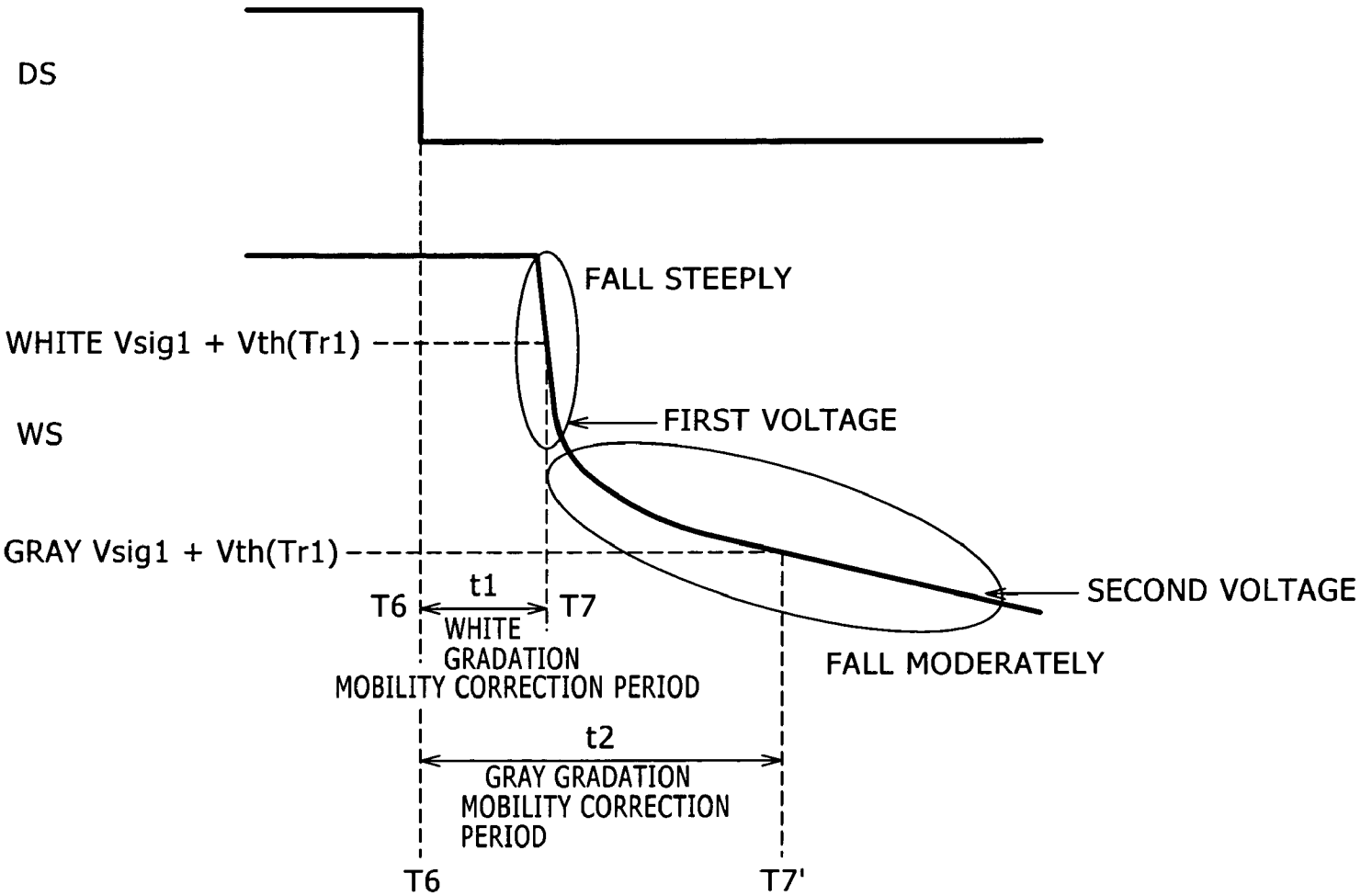
FIG. 8 is a waveform diagram illustrating operation of the display apparatus.

Therefore, the mobility correction period is automatically adjusted optimally in response to the level of the input image signal. This is described in detail with reference to FIG. 8. FIG. 8 shows a falling edge waveform of the control signal DS applied to the gate of the switching transistor Tr4. Since the switching transistor Tr4 is of the P-channel type, it turns on at a point of time (T6) at which the control signal DS falls. This timing T6 defines the start point of the mobility correction period described hereinabove. Also a falling edge waveform of the control signal WS is shown together with the control signal DS. This control signal WS is applied to the gate of the sampling transistor Tr1. As described hereinabove, since the sampling transistor Tr1 is of the N-channel type, it turns off at a point of time T7 at which the control signal WS falls and the mobility correction period ends.

When the waveform of the control signal WS turns off, the waveform of a pulse falls steeply to a suitable potential first, and then the waveform falls but in a moderated state to a final potential. Consequently, two or more mobility correction periods can be provided across a boundary provided by a gradation which depends upon the desired potential. For the convenience of description, the first voltage which falls steeply first is referred to as 1st voltage, and the moderately fallen final potential is referred to as 2nd voltage. Here, as a model, operation of the waveform of the control signal WS is studied wherein 1st and 2nd voltages are set to 1st voltage=8 V and 2nd voltage=4 V. Further, it is assumed that the threshold voltage of the sampling transistor Tr1 is Vth (Tr1)=2 V.

When the white gradation Vsig1=8 V is written in, the sampling transistor Tr1 cuts off at time T7 at which the control signal WS drops to Vsig1+Vth (Tr1)=10 V. In other words, when the signal potential Vsig=8 V is applied from the signal line to the source of the sampling transistor Tr1, the sampling transistor Tr1 cuts off at the gate potential of the sampling transistor Tr1 which is higher by the threshold voltage of 2 V than the source potential of the sampling transistor Tr1. In this manner, in the case of the white gradation, the mobility correction time t1=T7−T6 is determined from the timing T6 at which the control signal DS is turned on until the control signal WS drops steeply to the 1st voltage.

On the other hand, if the gray gradation Vsig2=4 V is written in, the cutoff voltage of the sampling transistor Tr1 becomes Vsig2+Vth (Tr1)=6 V. The point of time at which the control signal WS drops to 6 V of the cutoff voltage is a timing T7'. In the case of the gray gradation, the correction time t2 depends upon the point T7' at which the control signal WS is moderated from the 1st voltage at which the control signal WS becomes off to the 2nd voltage after timing T6 of the control signal DS. In other words, the correction time t2 in the case of the gray gradation can be taken longer than the correction time t1 in the case of the white gradation.

Further, where the gradation is low, for example, where the gradation is set to Vsig=3 V, the cutoff voltage of the sampling transistor Tr1 becomes 5 V similarly, and since the waveform is moderated, the cut off timing T7' is further displaced rearwardly and the mobility correction time becomes longer. In this manner, according to the present driving method, the mobility correction time t can be set longer as the gradation becomes lower.

In this manner, the time T7 until the control signal DS is first dropped steeply to the 1st voltage, at which the control signal WS is off, after the control signal DS is turned on is set in accordance with the mobility correction time t1 of the white gradation in this manner thereby to optimize the correction time of the white gradation. The 1st voltage is set taking the threshold voltage Vth (Tr1) into consideration so that the sampling transistor Tr1 is cut off at a steep point with certainty in the white gradation. Further, in regard to the low gradations, the optimum correction time t2 is found out at each gradation, and the 2nd voltage is set and the degree of moderation of the falling edge waveform of the control signal WS is determined in accordance with the optimum correction time t2. By automatically adjusting the time axis T suitable for each level from the high gradation to the low gradation in this manner to cancel the dispersion in mobility, irregular stripe patterns can be eliminated at all gradations.

Figure 9:
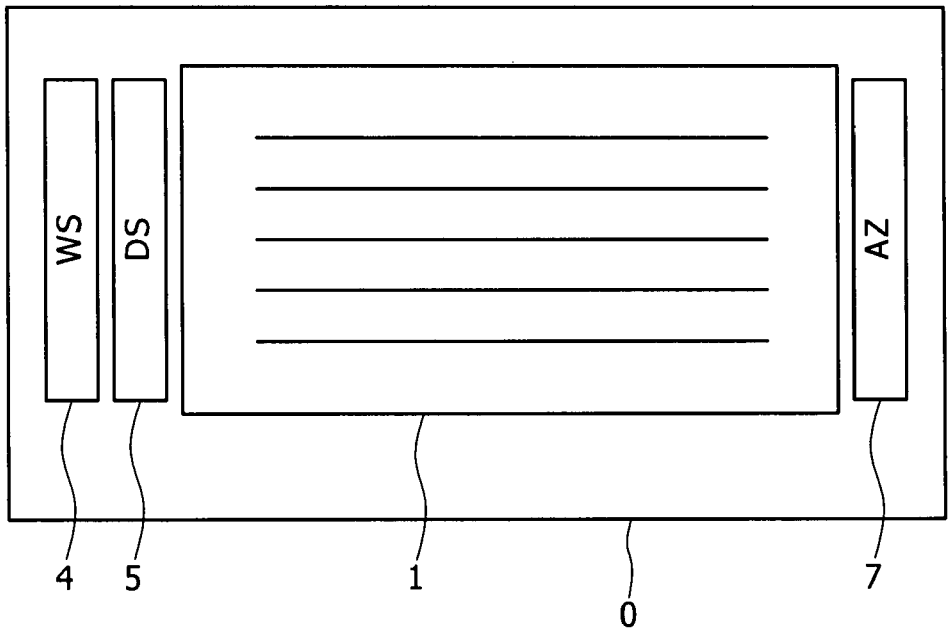
FIG. 9 is a schematic view showing a general configuration of another display apparatus to which the present invention is applied.

In the following, a method of producing the falling edge waveform of the control signal WS shown in FIG. 8 is described in detail. FIG. 9 illustrates a general configuration of a display apparatus by which the falling edge waveform of the control signal WS shown in FIG. 8 is produced. The display apparatus includes a panel 0 formed from a glass plate. A pixel array section 1 is formed integrally at a central portion of the panel 0. A write scanner 4, a drive scanner 5, a correcting scanner 7 and so forth which make part of the driving section are formed around the panel 0. It is to be noted that, though not shown, a horizontal selector can be incorporated similarly to the scanners on the panel 0. Or, an externally provided horizontal selector may be provided separately from the panel 0.

Figure 10:
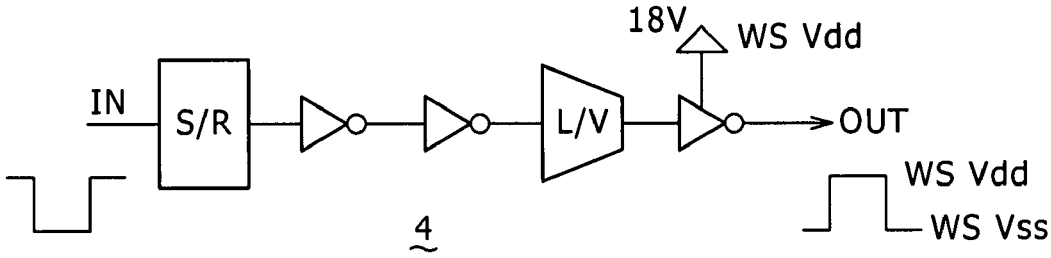
FIG. 10 is a circuit diagram showing an existing write scanner.

FIG. 10 schematically shows one stage of the write scanner 4 shown in FIG. 9. This stage corresponds to one row of scanning lines formed on the pixel array section 1. However, the stage of the write scanner 4 shown in FIG. 10 outputs a rectangular control pulse WS as in the case of an existing write scanner. As seen in FIG. 10, the stage of the write scanner 4 includes a series connection of a shift register S/R, two intermediate buffers, a level shifter L/V and one output buffer. To the output buffer at the last stage, a power supply voltage WSVdd (18 V) of the write scanner 4 is supplied. The write scanner first delays an input waveform IN transferred thereto from the preceding stage by one stage interval and supplies the delayed input waveform IN to the level shifter L/V through the intermediate buffers so that the input waveform IN is converted into a signal of a voltage level suitable to drive the output buffer. The output buffer produces an output waveform OUT having a waveform reversed from that of the input waveform IN and supplies the output waveform OUT to the corresponding scanning line WS. The output waveform OUT is a rectangular waveform and has a high level WSVdd and a reference level WSVss. Since the output waveform OUT has a vertical falling edge, the mobile correction period becomes fixed.

Figure 11:
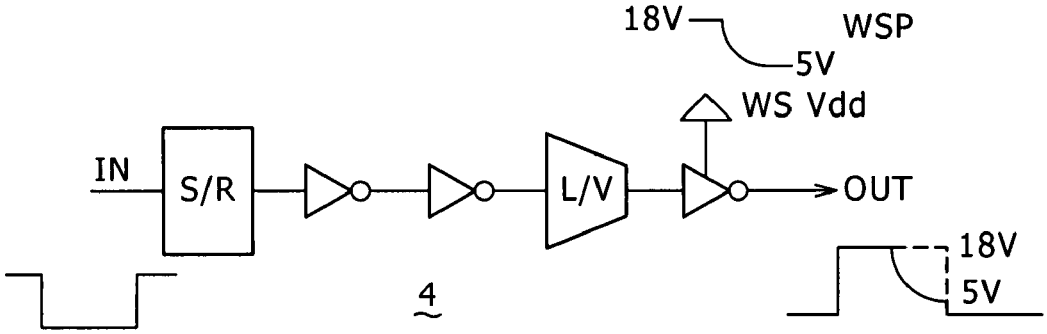
FIG. 11 is a circuit diagram showing a write scanner of the display apparatus of FIG. 9.

FIG. 11 shows one stage of the write scanner 4. The circuit shown in FIG. 11 is different from that of FIG. 10 in that the power supply voltage WSVdd to be supplied to the output buffer at the last stage has a pulse waveform which varies, for example, from 18 V to 5 V. This power supply pulse WSP is supplied from an external discrete circuit to the write scanner 4 of the panel 0. Thereupon, the phase of the power supply pulse WSP is adjusted in advance so that it may be synchronized with operation of the write scanner 4.

As seen in FIG. 11, when a rectangular pulse IN is inputted from the preceding stage to the stage shown, it is applied to the gate of the output buffer through the shift register S/R, two intermediate buffers and level shifter L/V. Consequently, the output buffer is opened, and the output waveform OUT is supplied to the corresponding scanning line. Thereupon, since the power supply pulse WSP is applied to the power supply voltage line WSVdd after the output buffer is turned on, the output waveform falls along a predetermined curve from 18 V toward 5 V. Thereafter, the output buffer is closed and the output waveform now has the WSVss level.

The waveform of the control signal DS which defines the mobile correction period in combination with the control signal WS can be produced by any of the configurations shown in FIGS. 10 and 11.

Figure 12:
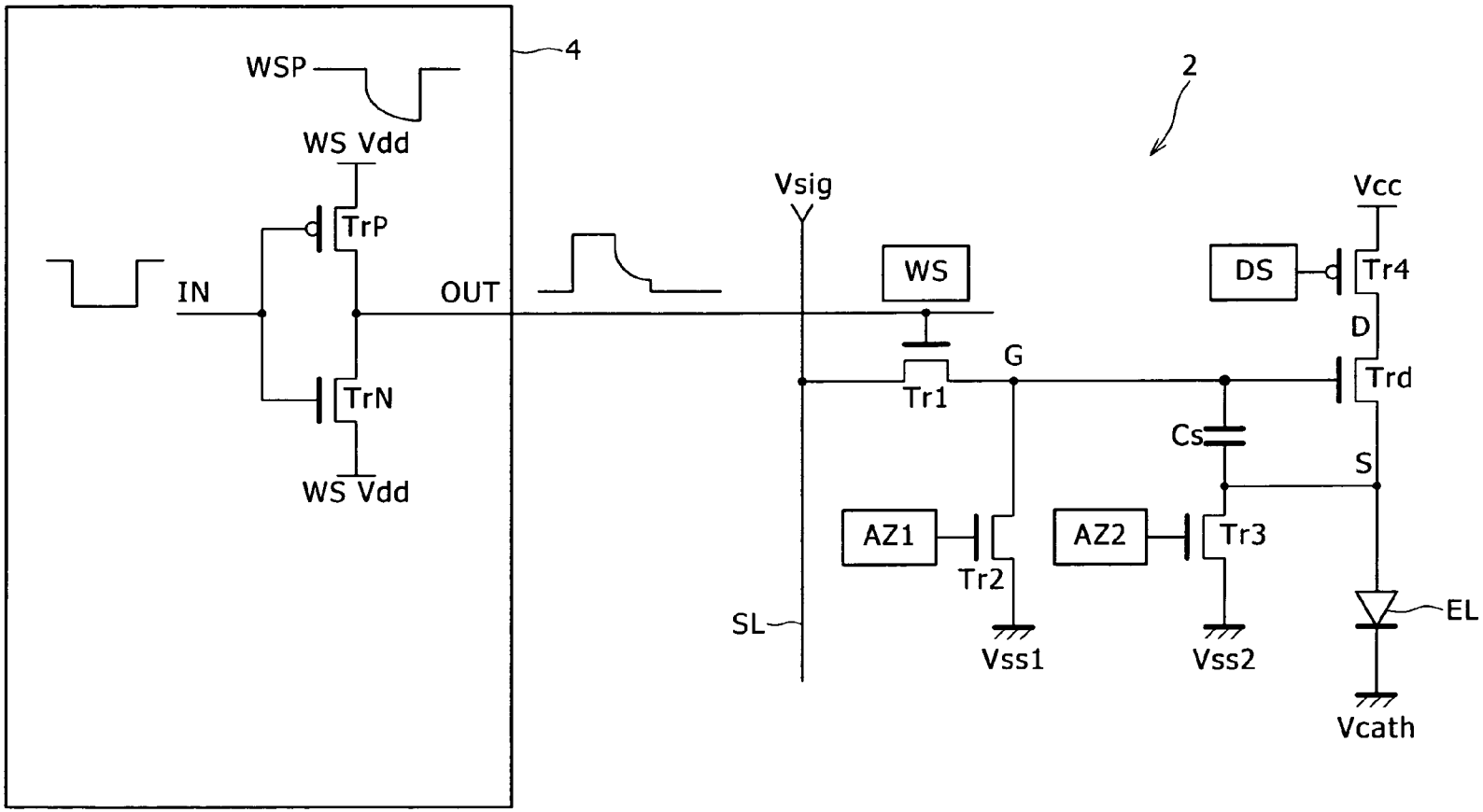
FIG. 12 is a schematic circuit diagram showing an output stage of the write scanner of FIG. 11.

FIG. 12 shows an example of a configuration of the last stage output buffer of the write scanner shown in FIG. 11. Referring to FIG. 12, the output buffer stage includes a P-channel transistor TrP and an N-channel transistor TrN paired with each other and connected in series between a power supply line WSVdd and a ground line WSVss. An input waveform IN is applied to the gate of the transistors TrP and TrN. A power supply pulse WSP having a phase adjusted with respect to the input waveform in advance is applied to the power supply line WSVdd. After the transistor TrP is rendered conducting in response to application of the input waveform IN, the falling edge waveform of the power supply pulse WSP is fetched into the transistor TrP and supplied as the output waveform OUT to the control signal WS of the pixel 2 side. It is to be noted that, as occasion demands, the falling edge waveform of the power supply pulse WSP may possibly pass through the transistor TrP from a relationship of the operation timing. In this instance, a masking signal may be applied to the output stage of the final buffer so as to cut the rear side rising edge of the power supply pulse WSP.

Figure 13:
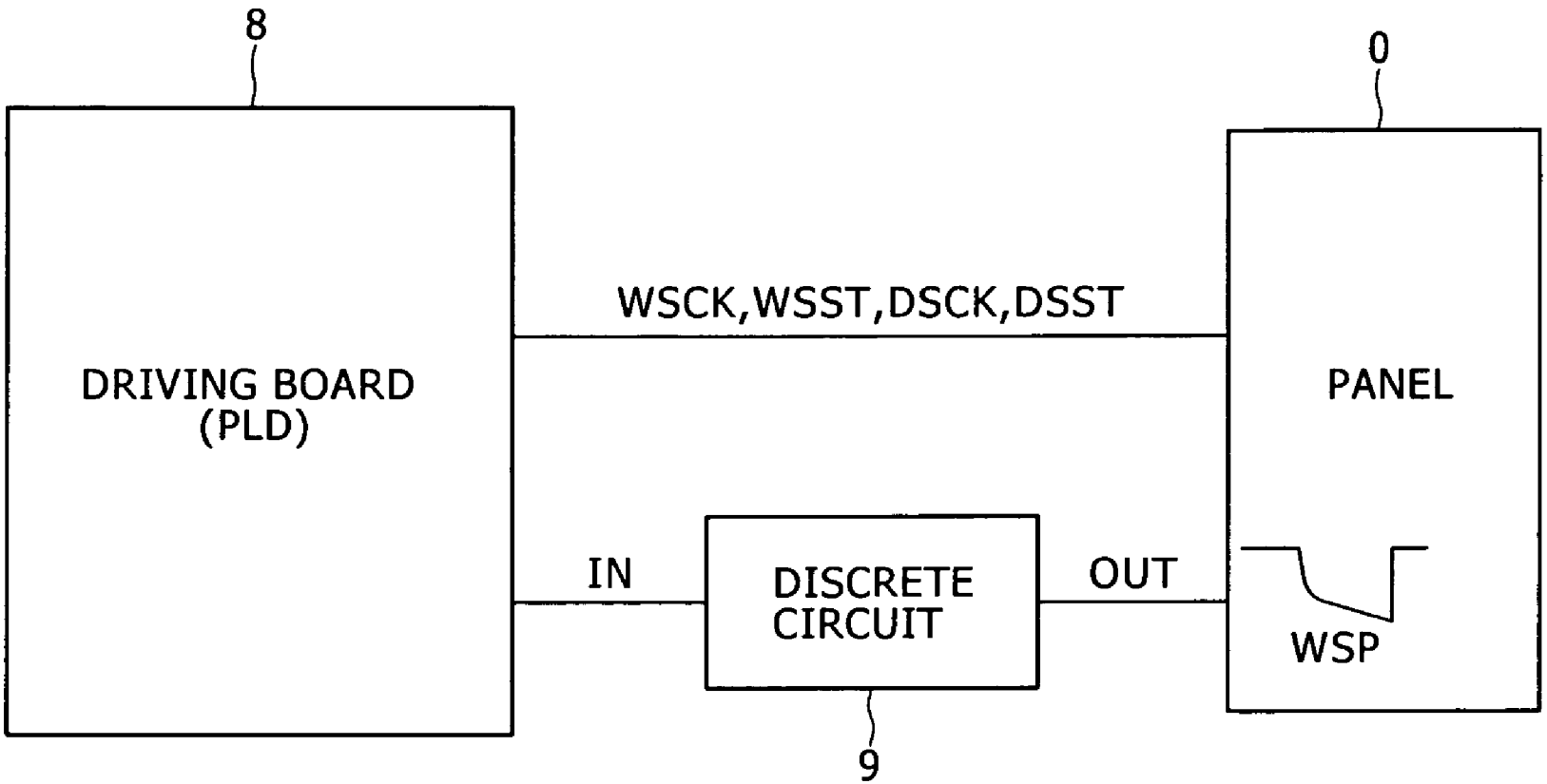
FIG. 13 is a block diagram showing a general configuration of the display apparatus of FIG. 9.

FIG. 13 schematically shows a general configuration of the display apparatus. The panel 0 has the configuration described hereinabove with reference to FIG. 9 and has built therein various scanners, which form part of the driving section, in addition to the pixel array section. Meanwhile, an externally provided driving board 8 and a discrete circuit 9 which are the remaining part of the driving section are connected to the panel 0. The driving board 8 is formed from a PLD (programmable logic device) and supplies clock signals WSCK and DSCK, start pulses WSST and DSST and so forth necessary for operation of the scanners incorporated in the panel 0. The discrete circuit 9 is interposed between the driving board 8 and the panel 0 and produces a necessary power supply pulse. In particular, the discrete circuit 9 receives an input waveform IN from the driving board 8 side, performs waveform processing for the input waveform IN to produce an output waveform OUT and supplies the output waveform OUT to the panel 0 side. The discrete circuit 9 is formed from discrete elements such as transistors, resistors and capacitors and at least supplies a power supply pulse WSP to the power supply line of the write scanner. As occasion demands, a power supply pulse DSP may be supplied to the power supply line of the drive scanner 5. The discrete circuit 9 produces the power supply pulses WSP and DSP in this manner and places them into the power supply lines to the write scanner and the drive scanner on the panel 0 side. Where the power supply pulse waveforms are produced by the externally provided discrete circuit 9 disconnected from the panel 0, it is possible to make up optimum waveforms and timings for each panel, and this contributes to improvement of the yield in irregular stripe pattern inspection of the panel 0.

Figure 14:
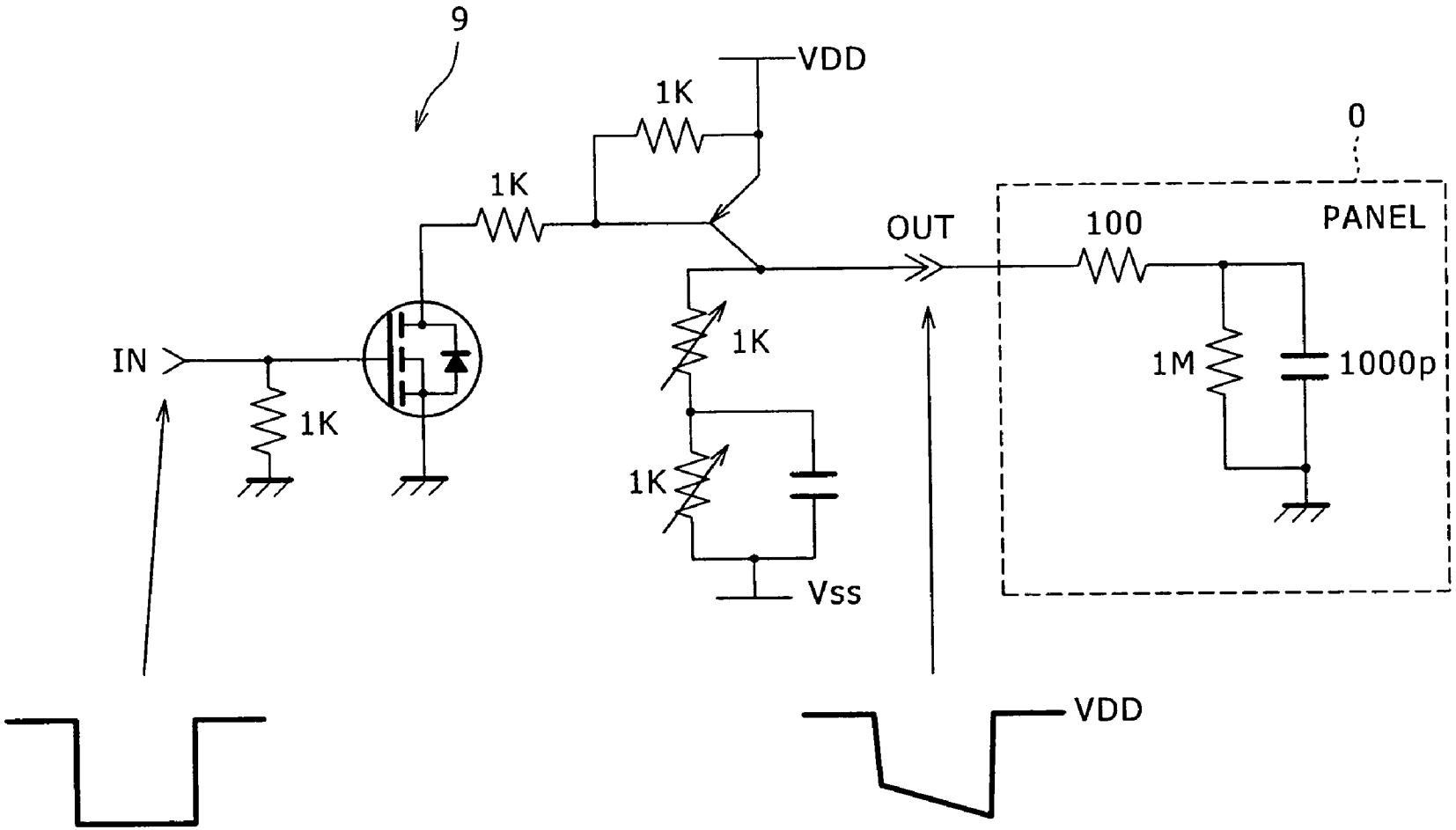
FIGS. 14 and 15 are circuit diagrams showing different examples of a configuration of a discrete circuit included in the display apparatus shown in FIG. 13.

FIG. 14 is a circuit diagram showing an example of the simplest configuration of the discrete circuit 9. Referring to FIG. 14, the discrete circuit 9 includes one transistor, one capacitor, three fixed resistors and two variable resistors, and processes the input waveform IN supplied thereto from the driving board 8 side in an analog fashion to produce an output waveform OUT, which is supplied to the panel 0 side. The discrete circuit 9 shown in FIG. 14 processes a rectangular input waveform to produce an output waveform whose falling edge varies at two stages along a polygonal line. As seen in FIG. 8, a falling edge of the output waveform is inclined steeply at the first state and is then inclined in a moderate gradient at the second stage.

Figure 15:
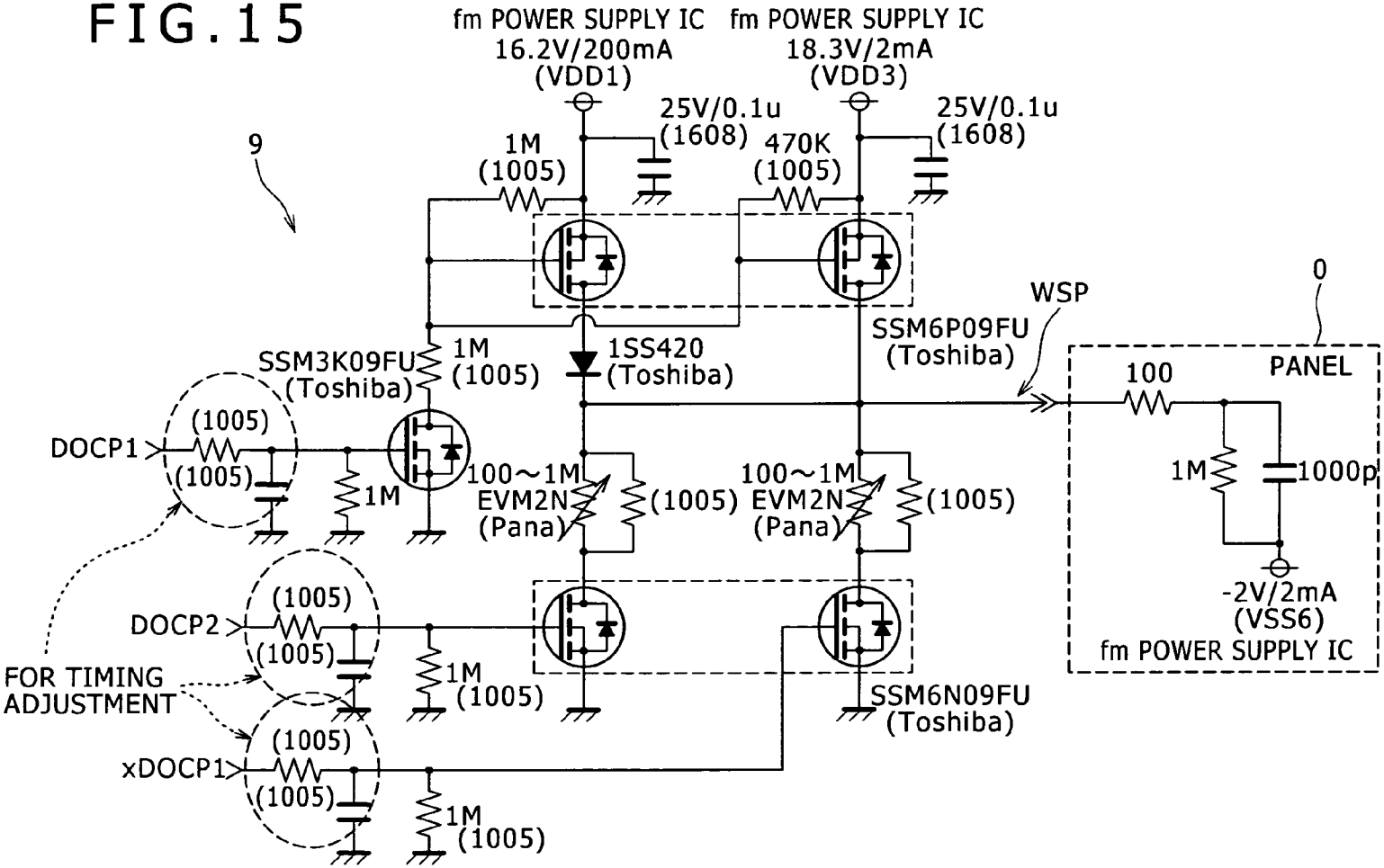

FIG. 15 is a circuit diagram showing an example of a more complicated configuration of the discrete circuit 9. Referring to FIG. 15, the discrete circuit 9 shown produces not such a power supply pulse WSP of a linear falling edge waveform as shown in FIG. 14 but a power supply pulse WSP having a falling edge waveform which varies curvilinearly, and supplies the power supply pulse WSP to the panel 0 side. The shape of the curve of the falling edge waveform can be set freely using a volume for the timing adjustment.

Figure 16:
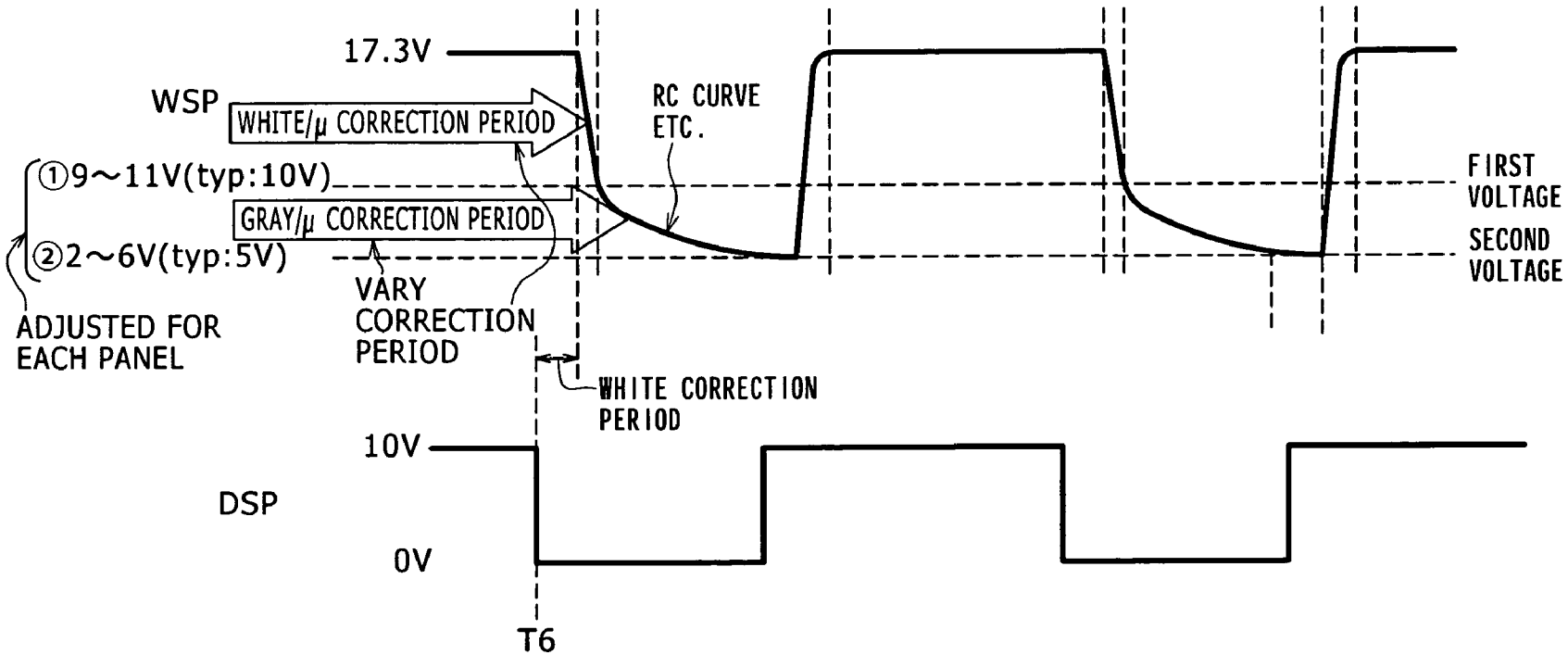
FIG. 16 is a waveform diagram showing output waveforms of the discrete circuit shown in FIG. 13.

FIG. 16 illustrates the waveform of the power supply pulse WSP produced by the discrete circuit 9 shown in FIG. 15. Also the waveform of the power supply pulse DSP is illustrated in a corresponding relationship to the power supply pulse WSP. It is to be noted that the falling edge waveform of the power supply pulse DSP is vertical but is not inclined particularly. Also in this instance, the falling timing of the power supply pulse DSP, that is, the on timing T6 of the switching transistor Tr4, can be adjusted freely by the discrete circuit side.

As seen from FIG. 16, the power supply pulse WSP falls suddenly from 17.3 V to the 1st voltage, and then falls moderately to the 2nd voltage. The 1st voltage can be adjusted within a range of 9 to 11 V for each panel. Typically, the 1st voltage is set to 10 V. Also the 2nd voltage can be adjusted within another range of 2 to 6 V for each panel. Typically, the 2nd voltage is set to 5 V. In addition, the falling edge waveform from the 1st voltage to the 2nd voltage can be designed in an RC curve or the like.

Incidentally, where the discrete circuit produces the power supply pulses WSP and DSP, it is possible to adjust the waveform of the control signals WS and DS outside the panel. Consequently, the discrete circuit can operate at optimum timings for each individual panel, which contributes to improvement of the yield of panels upon irregular stripe pattern inspection. However, in order to produce a power supply pulse by means of an externally provided discrete circuit, a driver and a power supply of high output power may be required, which gives rise to demerits such as increase of the power consumption and increase of the part cost.

Therefore, it seems recommendable to produce the control signal DS by a logic process in the inside of the panel. A display apparatus wherein the control signal DS is produced by a logic process in the inside of the panel is described below. In the display apparatus, in order to eliminate such demerits as high power consumption and increase of the cost arising from production of the power supply pulse DSP by means of a discrete circuit, the control signal DS is produced by a logic circuit in the panel to set the mobility correction period. Upon such setting, an enable signal for the control signal DS is established so as to enable adjustment of the mobile correction period. By establishing an enable signal by means of a logic circuit in the panel to produce the control signal DS in this manner, reduction of the power consumption and reduction of the cost can be anticipated.

Figure 17:
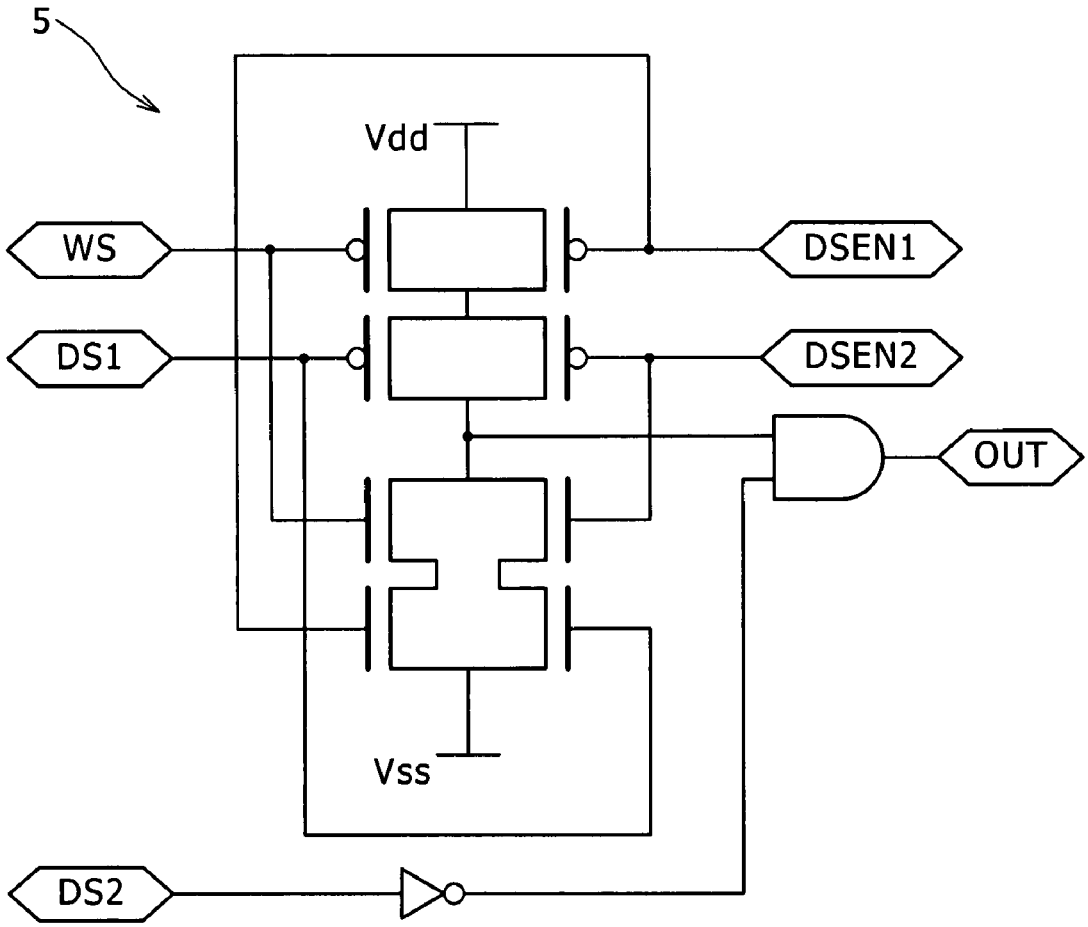
FIG. 17 is a circuit diagram showing an example of a configuration of a drive scanner which may be included in the display apparatus according to an embodiment of the present invention.

FIG. 17 is a circuit diagram showing an output stage of the drive scanner 5 having the logic processing function described above. Referring to FIG. 17, the output stage of the drive scanner 5 shown logically processes the control signals WS, DS1 and DS2 and enable signals DSEN1 and DSEN2 to obtain an output waveform. The output waveform is outputted as the control signal DS to the scanning line DS of the corresponding row. Here, the control signal WS represents a WS pulse (WS·S/R·in) to be inputted to the shift register SIR of the present stage of the write scanner 4. Meanwhile, the control signal DS1 indicates a DS pulse (DS·S/R·in) to be inputted to the shift register SIR of the present stage of the drive scanner 5. Meanwhile, the control signal DS2 indicates a DS pulse (DS·S/R·out) outputted from the shift register SIR of the present stage of the drive scanner 5.

Figure 18:
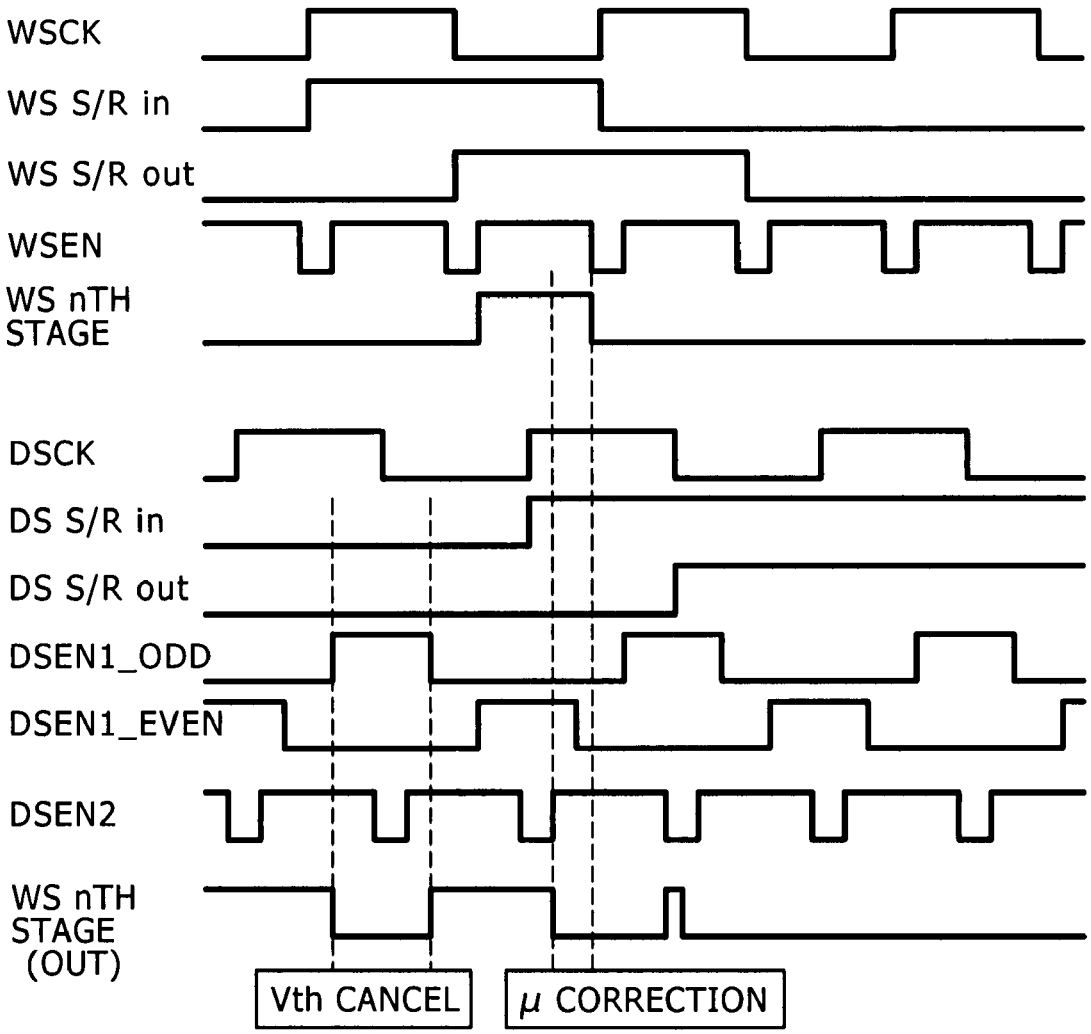
FIG. 18 is a timing chart illustrating operation of the drive scanner shown in FIG. 17.

FIG. 18 is a waveform diagram illustrating control signals and enable signals supplied to the logic circuit shown in FIG. 17 and associated clock signals. In the waveform diagram, the top five waveforms WSCK, WS·S/R·in, WS·S/R·out, WSEN and WSn indicate the waveform of control signals principally relating to the write scanner 4 side. As can be apparently seen from the waveform diagram, the write scanner 4 operates basically in response to the clock signal WSCK to successively transfer a start pulse by means of the shift register S/R to produce a control signal WSn for each stage. It is to be noted that, according to the present invention, one control signal WSn is not applied to a directly corresponding scanning line WSn, but a falling edge portion of the power supply pulse WSP is extracted using the signal WSn and supplied to the corresponding scanning line.

Signals DSCK, DS·S/R·in, DS·S/R·out, DSEN1_ODD, DSEN1_EVEN, DSEN2 and DSn(OUT) shown at a lower portion in FIG. 18 illustrate signal waveforms principally relating to the drive scanner 5.

In the logic circuit shown in FIG. 17, a logic process represented by a logic expression illustrated at an upper portion in FIG. 17 is performed to obtain the output waveform OUT. The output waveform OUT is illustrated at the lowest position in the timing chart of FIG. 18. As seen in FIG. 18, the control signal DSn includes portions which define a correction period for Vth cancellation and a mobility μ correction period. The Vth cancellation period can be adjusted with the enable signal DSEN1 while the mobility μ correction period can be adjusted with the enable signal DSEN2.

As described hereinabove, the display apparatus according to the present invention basically includes a pixel array section 1 and a driving section for driving the pixel array section 1. The pixel array section 1 includes first scanning lines WS and second scanning lines DS extending along rows, signal lines SL extending along columns, pixel circuits 2 arranged in a matrix at positions at which the first and second scanning lines WS and DS and the signal lines SL intersect with each other, and power supply lines Vcc and ground lines Vss for feeding the pixel circuits 2. The driving section includes a write scanner 4 for successively supplying a control signal WS to the scanning lines WS to line-sequentially scan the pixel circuits 2 in a unit of a row, a drive scanner 5 for successively supplying a control signal DS to the scanning lines DS in synchronism with the line sequential scanning, and a horizontal selector 3 for supplying an image signal to the signal lines SL in synchronism with the line sequential scanning.

Each of the pixel circuits 2 includes a light emitting element EL, a sampling transistor Tr1, a drive transistor Trd, a switching transistor Tr4, and a pixel capacitance Cs. The sampling transistor Tr1 is connected at the gate thereof to an associated first scanning line WS, at the source thereof to an associated signal line SL and at the drain thereof to the gate G of the drive transistor Trd. The drive transistor Trd and the light emitting element EL are connected in series between an associated third potential Vcc and an associated ground line to form a current path. The switching transistor Tr4 is inserted in the current path and is connected at the gate thereof to the second scanning line DS. The pixel capacitance Cs is connected between the source S and the gate G of the drive transistor Trd.

In the display apparatus having the configuration described above, the sampling transistor Tr1 is turned on in response to a first control signal WS supplied thereto from the first canning line WS to sample a signal potential Vsig of an image signal supplied thereto from the signal line SL and retain the signal potential Vsig into the pixel capacitance Cs. The switching transistor Tr4 is turned on in response to a second control signal DS supplied thereto from the second control signal DS to place the current path described above into a conductive state. The drive transistor Trd passes driving current Ids to the light emitting element EL through the current path in the conducting state in response to the signal potential Vsig retained in the pixel capacitance Cs.

The driving section applies the first control signal WS to the first scanning line WS to turn on the sampling transistor Tr1 to start sampling of the signal potential Vsig. Then, the driving section applies correction for the mobility μ of the drive transistor Trd to the signal potential Vsig retained in the pixel capacitance Cs within a correction period t from a first timing T6 at which the second control signal DS is applied to the second scanning line DS to turn on the switching transistor Tr4 to a second timing T7 at which the first control signal WS applied to the first scanning line WS is canceled to turn off the sampling transistor Tr1 thereby to perform mobility correction. Thereupon, the driving section automatically adjusts the second timing T7 so that the correction period t within which the signal potential Vsig of the image signal to be supplied to the signal line SL is high becomes shorter while the signal potential Vsig of the image signal to be supplied to the signal line SL is low becomes longer.

In particular, the first scanner 4 in the driving section automatically adjusts the second timing T7 to apply a gradient to the falling edge waveform when the sampling transistor Tr1 is to be turned off at the second timing T7 so that the correction period t within which the signal potential Vsig of the image signal to be supplied to the signal line SL is high becomes shorter whereas the correction period t within which the signal potential Vsig of the image signal to be supplied to the signal line SL is low becomes longer. Preferably, when a gradient is to be applied to the falling edge waveform of the first control signal WS, the first scanner 4 divides the falling edge waveform of the first control signal WS at least into two stages and applies a steep gradient to the first portion but applies a moderate gradient to the second portion thereby to optimize the correction period t both when the signal potential Vsig is high and when the signal potential Vsig is low.

Each of the pixel circuits 2 has a threshold voltage Vth correction function of the drive transistor in addition to the mobility correction function described above. In particular, each pixel circuit includes additional switching transistors Tr2 and Tr3 for resetting or initializing the gate potential (G) and the source potential (S) of the drive transistor Trd in prior to sampling of the image signal. The second scanner 5 temporarily turns on the switching transistor Tr4 through the second control line DS prior to sampling of the image signal thereby to allow driving current Ids to the drive transistor Trd in the reset state so that a voltage corresponding to the threshold voltage Vth of the drive transistor Trd is retained into the pixel capacitance Cs.

The driving section includes an externally provided power supply pulse production circuit (discrete circuit) in addition to the various scanners built in the panel. The current pulse production circuit 9 supplies a first power supply pulse WSP, on which a falling edge waveform of the first control signal WS is to be based, to the first scanner 4 in the panel. The first scanner 4 successively extracts a falling edge waveform from the first power supply pulse WSP and supplies the extracted falling edge waveform as a falling edge waveform of the first control signal WS to the first scanning line WS.

In a certain form, the power supply pulse production circuit 9 produces also a second power supply pulse DSP, on which a waveform of the second control signal DS is based, and supplies the second power supply pulse DSP to the second scanner 5. The second scanner 5 extracts part of the waveform from the second power supply pulse DSP and supplies the extracted waveform as a waveform of the second control signal at a first timing T6 to the scanning lines DS.

In another certain form, the first scanner 4 produces a waveform of the first control signal WS at a second timing T7 which defines an end timing of the correction period t based on the first power supply pulse WSP supplied from the power supply pulse production circuit 9. Meanwhile, the second scanner 5 produces a waveform of the second control signal DS at a first timing T6 which defines a start timing of the correction period t through an internal logical process.

The display apparatus according to the present invention described above can be applied as a display apparatus of such various electric apparatus as shown in FIGS. 19A to 19G. In particular, the display apparatus can be applied to various electronic apparatus in various fields wherein an image signal inputted to or produced in the electronic apparatus is displayed as an image, such as, for example, digital cameras, notebook type personal computers, portable telephone sets and video cameras.

It is to be noted that the display apparatus according to the present invention may be formed as such an apparatus of a module type as shown in FIG. 20. For example, the display apparatus in this instance may be a display module wherein the pixel array section is adhered to an opposing portion of a glass plate or the like. A color filter, a protective film, a light intercepting film or the like may be provided on the transparent opposing portion. It is to be noted that the display module may include a flexible printed circuit (FPC) for inputting and outputting signals and so forth from the outside to the pixel array section and vice versa.

In the following, examples of the electronic apparatus to which the display apparatus is applied are described.

FIG. 19A shows a television set having a video display screen 1002 made up of a front panel 1002, etc. The display apparatus according to an embodiment of the present invention is incorporated in the video display screen 1001.

FIGS. 19B and 19C show a digital camera including an image capturing lens 2001, a flash light-emitting section 2002, a display section 2003, etc. The display apparatus according to an embodiment of the present invention is incorporated in the display section 2003.

FIG. 19D shows a video camera including a main body 3001, a display panel 3002, etc. The display apparatus according to an embodiment of the present invention is incorporated in the display panel 3002.

FIGS. 19E and 19F show a cellular phone unit including a display panel 4001, an auxiliary display panel 4002, etc. The display apparatus according to an embodiment of the present invention is incorporated in the display panel 4001 and the auxiliary display panel 4002.

FIG. 19G shows a notebook personal computer including a main body 5001 having a keyboard 5002 for entering characters and so forth, and a display panel 5003 for displaying images. The display apparatus according to an embodiment of the present invention is incorporated in the display panel 5003.

While preferred embodiments of the present invention have been described using specific terms, such description is for illustrative purpose only, and it is to be understood that changes and variations may be made without departing from the spirit or scope of the following claims.

What is claimed is:

1. A display apparatus, comprising:

a pixel array section; and a driving section configured to drive said pixel array section;

said pixel array section including a plurality of first scanning lines and a plurality of second scanning lines extending along rows, a plurality of signal lines extending along columns, a plurality of pixels arranged in a matrix at positions at which said first and second scanning lines and said signal lines intersect with each other, and a plurality of power supply lines and a plurality of ground lines configured to perform feeding to said pixels;

said driving section including a first scanner configured to successively supply a first control signal to said first scanning lines to perform line sequential scanning of said pixels in a unit of a row, a second scanner configured to successively supply a second control signal to said second scanning lines in accordance with the line sequential scanning, and a signal selector configured to supply an image signal to said signal lines in accordance with the line sequential scanning;

each of said pixels including a light emitting element, a sampling transistor, a drive transistor, a switching transistor, and a pixel capacitance, said sampling transistor being connected at the gate, source and drain thereof to a corresponding one of said first scanning lines, a corresponding one of said signal lines and the gate of said drive transistor, respectively, said drive transistor and said light emitting element being connected in series between a corresponding one of said power supply lines and a corresponding one of said ground lines to form a current path, said switching transistor being inserted in the current path, said switching transistor being connected at the gate thereof to a corresponding one of said second scanning lines, said pixel capacitance being connected between the source and gate of said drive transistor, said sampling transistor being switched on in response to the first control signal supplied thereto from the first scanning line to sample a signal potential of the image signal supplied from the signal line and retain the signal potential into said pixel capacitance, said switching transistor being switched on in response to the second control signal supplied from the second scanning line to place the current path into a conducting state, said drive transistor supplying driving current to said light emitting element through the current path placed in the conducting state in response to the signal potential retained in said pixel capacitance;

said driving section applying correction for the mobility of said drive transistor to the signal potential retained in said pixel capacitance within a correction period from a first timing at which, after the first control signal is applied to the first scanning line to turn on said sampling transistor to start sampling of the signal potential, the second control signal is applied to the second scanning line to turn on said switching transistor to a second timing at which the first control signal applied to the first scanning line is cancelled to turn off said sampling transistor thereby to automatically adjust the second timing such that the correction period decreases as the signal potential of the image signal supplied to the signal line increases but the correction period increases as the signal potential of the image signal supplied to the signal line decreases.

2. The display apparatus according to claim 1, wherein each of said pixels further includes an additional switching transistor configured to reset the gate potential and source potential of said drive transistor prior to the sampling of the image signal, and said second scanner temporarily turns on said switching transistor through the second control line prior to the sampling of the image signal thereby to supply driving current to said drive transistor in the reset state to retain a voltage corresponding to the threshold voltage of said drive transistor into said pixel capacitance.

3. The display apparatus according to claim 1, wherein said first scanner applies a gradient to a falling edge waveform of the first control signal when said sampling transistor is switched off at the second timing to automatically adjust the second timing such that the correction period decreases as the signal potential increases but the correction period increases as the signal potential of the image signal supplied to the signal line decreases.

4. The display apparatus according to claim 3, wherein, when the gradient is applied to the falling edge waveform of the first control signal, said first scanner first applies a steep gradient to the falling edge waveform of the first control signal and then applies a moderate gradient to the falling edge waveform of the first control signal so that the correction period is optimized in both cases wherein the signal potential is high and wherein the signal potential is low.

5. The display apparatus according to claim 3, wherein said driving section includes a power supply pulse production circuit configured to produce a first power supply pulse on which the falling edge waveform of the first control signal is based and supply the first power supply pulse to said first scanner, and said first scanner successively extracts the falling edge waveform from the first power supply pulse and supplies the extracted falling edge waveform as the falling edge waveform of the first control signal to the first scanning line.

6. The display apparatus according to claim 5, wherein said power supply pulse production circuit produces a second power supply pulse on which the waveform of the second control signal is based and supplies the produced second power supply pulse to said second scanner, and said second scanner successively extracts part of the waveform from the second power supply pulse and supplies the extracted waveform as the waveform of the second control signal at the first timing to the second scanning line.

7. The display apparatus according to claim 5, wherein said first scanner produces the waveform of the first control signal at the second timing which is an end point of the correction period based on the first power supply pulse supplied from said power supply pulse production circuit, and said second scanner produces the waveform of the second control signal at the first timing which is a start point of the correction period by an internal logical process.

8. A driving method for a display apparatus which includes a pixel array section and a driving section configured to drive said pixel array section, said pixel array section including a plurality of first scanning lines and a plurality of second scanning lines extending along rows, a plurality of signal lines extending along columns, a plurality of pixels arranged in a matrix at positions at which said first and second scanning lines and said signal lines intersect with each other, and a plurality of power supply lines and a plurality of ground lines configured to perform feeding to said pixels, said driving section including a first scanner configured to successively supply a first control signal to said first scanning lines to perform line sequential scanning of said pixels in a unit of a row, a second scanner configured to successively supply a second control signal to said second scanning lines in accordance with the line sequential scanning, and a signal selector configured to supply an image signal to said signal lines in accordance with the line sequential scanning, and each of said pixels including a light emitting element, a sampling transistor, a drive transistor, a switching transistor and a pixel capacitance, said sampling transistor being connected at the gate, source and drain thereof to a corresponding one of said first scanning lines, a corresponding one of said signal lines and the gate of said drive transistor, respectively, said drive transistor and said light emitting element being connected in series between a corresponding one of said power supply lines and a corresponding one of said ground lines to form a current path, said switching transistor being inserted in the current path, said switching transistor being connected at the gate thereof to a corresponding one of said second scanning lines, said pixel capacitance being connected between the source and gate of said drive transistor, comprising the steps of:

switching on said sampling transistor in response to the first control signal supplied from the first scanning line to sample a signal potential of the image signal supplied from the signal line and retain the signal potential into said pixel capacitance;

switching on said switching transistor in response to the second control signal supplied from the second scanning line to place the current path into a conducting state;

supplying driving current from said drive transistor to said light emitting element through the current path placed in the conducting state in response to the signal potential retained in said pixel capacitance;

applying the first control signal to the first scanning line to turn on said sampling transistor to start sampling of the signal potential; and applying correction for the mobility of said drive transistor to the signal potential retained in said pixel capacitance within a correction period from a first timing at which the second control signal is applied to the second scanning line to turn on said switching transistor to a second timing at which the first control signal applied to the first scanning line is cancelled to turn off said sampling transistor thereby to automatically adjust the second timing such that the correction period decreases as the signal potential of the image signal supplied to the signal line increases but the correction period increases as the signal potential of the image signal supplied to the signal line decreases.

* * * * *